US012781532B2

(12) United States Patent
Lizarraga

(10) Patent No.: US 12,781,532 B2
(45) Date of Patent: Nov. 3, 2026

(54) DEPLOYABLE FENCE SYSTEM

(71) Applicant: Marco Lizarraga, San Diego, CA (US)

(72) Inventor: Marco Lizarraga, San Diego, CA (US)

( * ) Notice: Subject to any disclaimer, the term of this patent is extended or adjusted under 35 U.S.C. 154(b) by 429 days.

(21) Appl. No.: 18/212,012

(22) Filed: Jun. 20, 2023

(65) Prior Publication Data

US 2023/0417076 A1 Dec. 28, 2023

Related U.S. Application Data

(60) Provisional application No. 63/355,041, filed on Jun. 23, 2022.

(51) Int. Cl.
*E04H 17/14* (2006.01)

(52) U.S. Cl.
CPC ..... *E04H 17/1448* (2021.01); *E04H 17/1426* (2013.01)

(58) Field of Classification Search
CPC ... E04H 17/004; E04H 17/009; E04H 17/013; E04H 17/055; E04H 17/1417; E04H 17/1426; E04H 17/143; E04H 17/1439; E04H 17/1445; E04H 17/1447; E04H 17/1448; E04H 17/1452; E04H 17/1469; E04H 17/1473; E04H 17/1486; E04H 17/1488; E04H 17/1602; E04H 17/164; E04H 17/165; E04H 17/166; E04H 17/17; E04H 17/18; E04H 17/185; E04H 17/22; A01K 1/02; A01K 3/005; A01K 3/006; A47D 13/061; A47D 13/066; E04F 11/1817; E04F 11/1834; E04F 11/1865; E04F 2011/1819; E04F 2011/1823; E04F 2011/1831

(Continued)

(56) References Cited

U.S. PATENT DOCUMENTS 2,346,111 A * 4/1944 MacKenzie ..... E04H 17/1426 160/161
2,560,014 A * 7/1951 Wadsworth ..... E04H 17/1439 256/22

(Continued)

FOREIGN PATENT DOCUMENTS

CA 2638709 A1 * 2/2010 ..... E04H 17/1417
DE 4031781 A1 * 4/1991 ..... E01F 13/02

(Continued)

OTHER PUBLICATIONS

Amazon., retrieved from https://www.amazon.ca/HyperSun-Foldable-Portable-14-Panel-Toddlers/dp/B09C1K6884.

(Continued)

*Primary Examiner* — Amber R Anderson
*Assistant Examiner* — Kevin J Baynes
(74) *Attorney, Agent, or Firm* — Foley & Lardner LLP

(57) ABSTRACT

A fencing system includes a first set of pickets, a second set of pickets, a first hinge knuckle coupled to a first side of a first picket of the first set of pickets, a second hinge knuckle coupled to a second side of a second picket of the second set of pickets and a double hinge pin. The double hinge pin includes a first pin and a second pin conjoined together. The first pin of the double hinge pin is inserted into the first hinge knuckle, and the second pin of the double hinge pin is inserted into the second hinge knuckle.

20 Claims, 26 Drawing Sheets

(58) Field of Classification Search
USPC ..... 256/25, 26, 73
See application file for complete search history.

(56) References Cited

U.S. PATENT DOCUMENTS 3,534,512 A * 10/1970 Ballas ..... E04B 1/3445 52/143
3,970,045 A * 7/1976 Graham, Jr. ..... A01K 3/001 119/843
4,130,272 A * 12/1978 Emmie ..... E04H 17/1426 256/22
4,142,809 A * 3/1979 Shell ..... F16B 7/00 403/201
4,260,138 A * 4/1981 Freer ..... E04H 17/1426 256/12.5
4,787,602 A * 11/1988 Pidgeon ..... E01F 13/02 403/348
4,844,424 A * 7/1989 Knudslien ..... E04H 17/18 256/73
4,951,925 A * 8/1990 Schultz ..... E04H 17/1488 256/22
5,190,268 A * 3/1993 Espinueva ..... E04H 17/1417 256/65.01
5,362,030 A * 11/1994 Iler, Jr. ..... E04H 17/1413 256/26
5,601,278 A * 2/1997 Graber ..... E04H 17/143 256/66
5,609,327 A * 3/1997 Amidon ..... E04H 17/18 256/65.01
5,660,376 A * 8/1997 West ..... E04H 17/143 256/22
6,481,697 B1 * 11/2002 Brown ..... E04F 11/1834 256/64
7,726,633 B2 * 6/2010 Cook ..... E04H 17/1439 256/22
7,887,029 B2 * 2/2011 Flannery ..... E06B 9/06 256/65.16
8,511,648 B2 * 8/2013 McCarthy ..... E04H 17/1404 256/65.01
8,528,257 B2 * 9/2013 Kobayashi ..... A01K 1/034 49/463
8,662,478 B1 * 3/2014 Jones, Jr. ..... E04H 17/143 256/25
8,690,201 B2 * 4/2014 Frazier ..... E05C 1/04 256/73
9,127,424 B2 * 9/2015 James ..... E01F 15/088
9,500,000 B2 * 11/2016 McCarty ..... E04H 17/20
9,574,370 B2 * 2/2017 Presti ..... E04H 17/1488
9,624,630 B1 * 4/2017 Maus ..... E01F 13/022
10,100,474 B2 * 10/2018 Crotty ..... G02B 5/12
10,787,838 B2 * 9/2020 Larsen ..... E04H 17/166
11,053,720 B1 * 7/2021 Marick ..... E05D 3/14
11,421,441 B2 * 8/2022 Howell ..... E04H 17/20
11,530,546 B1 * 12/2022 Negron ..... E04B 1/3445
11,542,721 B2 * 1/2023 Langenwalter ..... E04H 17/1439
2004/0144967 A1 * 7/2004 Kuc, Sr. ..... E04H 17/1439 256/65.11
2004/0169172 A1 * 9/2004 Stringer ..... E04H 17/1426 256/67
2007/0181866 A1 * 8/2007 Strong ..... E04H 17/1602 256/65.02
2008/0296548 A1 * 12/2008 McDonald ..... A01K 1/0005 256/26
2015/0014620 A1 * 1/2015 Holmes ..... E04H 17/18 256/65.02
2019/0085589 A1 * 3/2019 McKinney ..... E04H 17/1439
2024/0040993 A1 * 2/2024 Brauer ..... A01K 29/005

FOREIGN PATENT DOCUMENTS

FR 2991346 A1 * 12/2013 ..... E04H 17/16
GB 2587176 A * 3/2021 ..... E04H 17/21

OTHER PUBLICATIONS

Wayfair., retrieved from the internet: https://www.wayfair.com/HyperSun-Foldable-Playpen-Kids-Safety-Gate-HS003-L952-K-HGER 1001.html?refid=GX528880927800-HGER 1001 &device.htm, retrieved on Jul. 29, 2022, 1 page.

* cited by examiner

DEPLOYABLE FENCE SYSTEM

CROSS-REFERENCE TO RELATED APPLICATION

This application claims priority to and the benefit of U.S. Provisional Application No. 63/355,041, filed Jun. 23, 2022, which is incorporated herein by reference in its entirety for all purposes.

FIELD OF THE DISCLOSURE

The present disclosure is generally related to a modular fence.

BACKGROUND

A fence may be a structure for enclosing or dividing an area. In one aspect, a fence can separate different areas to indicate different ownerships of different areas. For example, houses in different areas can be separated by a fence to indicate a geographical boundary between the two houses. In one aspect, a fence can separate an area into different areas for different purposes. In addition, a fence can provide privacy by visually obstructing the other side of the fence.

SUMMARY

Various embodiments disclosed herein are related to a fencing system. In some embodiments, the fencing system includes a first set of pickets and a second set of pickets. In some embodiments, the fencing system includes a first hinge knuckle coupled to a first side of a first picket of the first set of pickets, and a second hinge knuckle coupled to a second side of a second picket of the second set of pickets. In some embodiments, the fencing system includes a double hinge pin including a first pin and a second pin conjoined together. The first pin of the double hinge pin may be inserted into the first hinge knuckle, and the second pin of the double hinge pin inserted into the second hinge knuckle.

In some embodiments, the first set of pickets is folded flat against the second set of pickets in a first mode. In some embodiments, the first set of pickets and the second set of pickets are unfolded in a second mode.

In some embodiments, the first hinge knuckle has a cylindrical internal passage with a circumference at least a circumference of the first pin. The first hinge knuckle may include a protruding structure on a first portion of an outer surface of the first hinge knuckle. The protruding structure may have a shape corresponding to a portion of a shape of a hole in a picket fence wall of the first picket.

In some embodiments, the first hinge knuckle includes a first locking structure on a second portion of the outer surface of the first hinge knuckle. The second portion of the outer surface may be adjacent to the first portion of the outer surface. In some embodiments, the picket fence wall is inserted in a first space between the first locking structure and a third portion of the outer surface of the first hinge knuckle. The third portion of the outer surface may be adjacent to the second portion of the outer surface.

In some embodiments, the first locking structure includes a first structure coupled to the second portion of the outer surface of the first hinge knuckle and a second structure coupled to the first structure. In some embodiments, the second structure is separated from the third portion of the outer surface of the first hinge knuckle by a distance greater than a thickness of the picket fence wall of the first picket.

In some embodiments, the fencing system further includes a retainer clip coupled to the second structure. The retainer clip may have a perimeter larger than a circumference of the hole in the first picket.

In some embodiments, the first hinge knuckle includes another protruding structure on the outer surface of the first hinge knuckle. The another protruding structure may have a shape corresponding to a portion of a shape of a second hole in the first picket. In some embodiments, the shape of the protruding structure is an upper half of a circle, and the shape of the another protruding structure is a lower half of a circle.

In some embodiments, the first set of pickets includes a third picket adjacent to the first picket. In some embodiments, the third picket is farther away from the second picket than the first picket.

In some embodiments, the first set of pickets is placed on a higher portion of an inclined surface of a ground than the second set of pickets. In some embodiments, the first pin and the second pin of the double hinge pin have different lengths.

In some embodiments, the fencing system includes a first leveler extending from an end of the first picket towards a first portion of the inclined surface, and a second leveler extending from an end of the second picket towards a second portion of the inclined surface. The first leveler may be extended by a larger amount than the second leveler.

In some embodiments, the fencing system further includes a first rail for coupling the first set of pickets. In some embodiments, the fencing system further includes a second rail for coupling the second set of pickets. In some embodiments, each of the first set of pickets has a first recessed outer surface. The first rail may be coupled to the first recessed outer surfaces of the first set of pickets. Each of the second set of pickets may have a second recessed outer surface. The second rail may be coupled to the second recessed outer surfaces of the second set of pickets.

In some embodiments, the fencing system includes a first rail for coupling the first set of pickets. In some embodiments, the fencing system includes a second rail for coupling the second set of pickets. Each of the first set of pickets may have a first recessed inner surface. The first rail may be coupled to the first recessed inner surfaces of the first set of pickets. Each of the second set of pickets may have a second recessed inner surface. The second rail may be coupled to the second recessed inner surfaces of the second set of pickets.

In some embodiments, the fencing system further includes a third hinge knuckle coupled to a third side of a third picket of the first set of pickets. In some embodiments, the fencing system further includes another double hinge pin including a third pin inserted into the third hinge knuckle, and a fourth pin inserted into a fourth hinge knuckle coupled to a wall adjacent to a door or a frame of the door.

In some embodiments, the fencing system further includes a stake extending from an end of the first picket towards a surface of a ground.

In some embodiments, the fencing system further includes a lattice and a lattice holder. The lattice holder may include a picket end including two first arms that are spaced by a first thickness of the first picket. The first picket may be inserted into the two first arms of the picket end. The lattice holder may include a lattice end including two second arms spaced by a second thickness of the lattice. The lattice may be inserted into the two second arms of the lattice end.

Various embodiments disclosed herein are related to a fencing system. In some embodiments, the fencing system includes a plurality of picket fence segments. In some embodiments, the fencing system includes a plurality of hinge knuckles. Each of the plurality of hinge knuckles may be coupled to a corresponding picket fence segment from the plurality of picket fence segments. In some embodiments, the fencing system includes a plurality of double hinge pins including a first pin and a second pin coupled to the first pin. The first pin of a first double hinge pin of the plurality of double hinge pins may be inserted into a first hinge knuckle of the plurality of hinge knuckles coupled to a first picket fence segment of the plurality of picket fence segments. The second pin of the first double hinge pin of the plurality of double hinge pins may be inserted into a second hinge knuckle of the plurality of hinge knuckles coupled to a second picket fence segment of the plurality of picket fence segments adjacent to the first picket fence segment.

In some embodiments, the first picket fence segment of the plurality of picket fence segments is vertically offset with respect to the second picket fence segment of the plurality of picket fence segments. In some embodiments, the first pin and the second pin have different lengths.

In some embodiments, ends of pickets of each of the plurality of picket fence segments are extendable by different amounts.

In some embodiments, the first hinge knuckle of the plurality of hinge knuckles is coupled to a first picket of the first picket fence segment. In some embodiments, a third hinge knuckle of the plurality of hinge knuckles is coupled to a second picket of the first picket fence segment. In some embodiments, the first pin of a second double hinge pin of the plurality of double hinge pins is inserted into the third hinge knuckle of the plurality of hinge knuckles, and the second pin of the second double hinge pin of the plurality of double hinge pins is inserted into a fourth hinge knuckle coupled to a wall adjacent to a door or a frame of the door.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
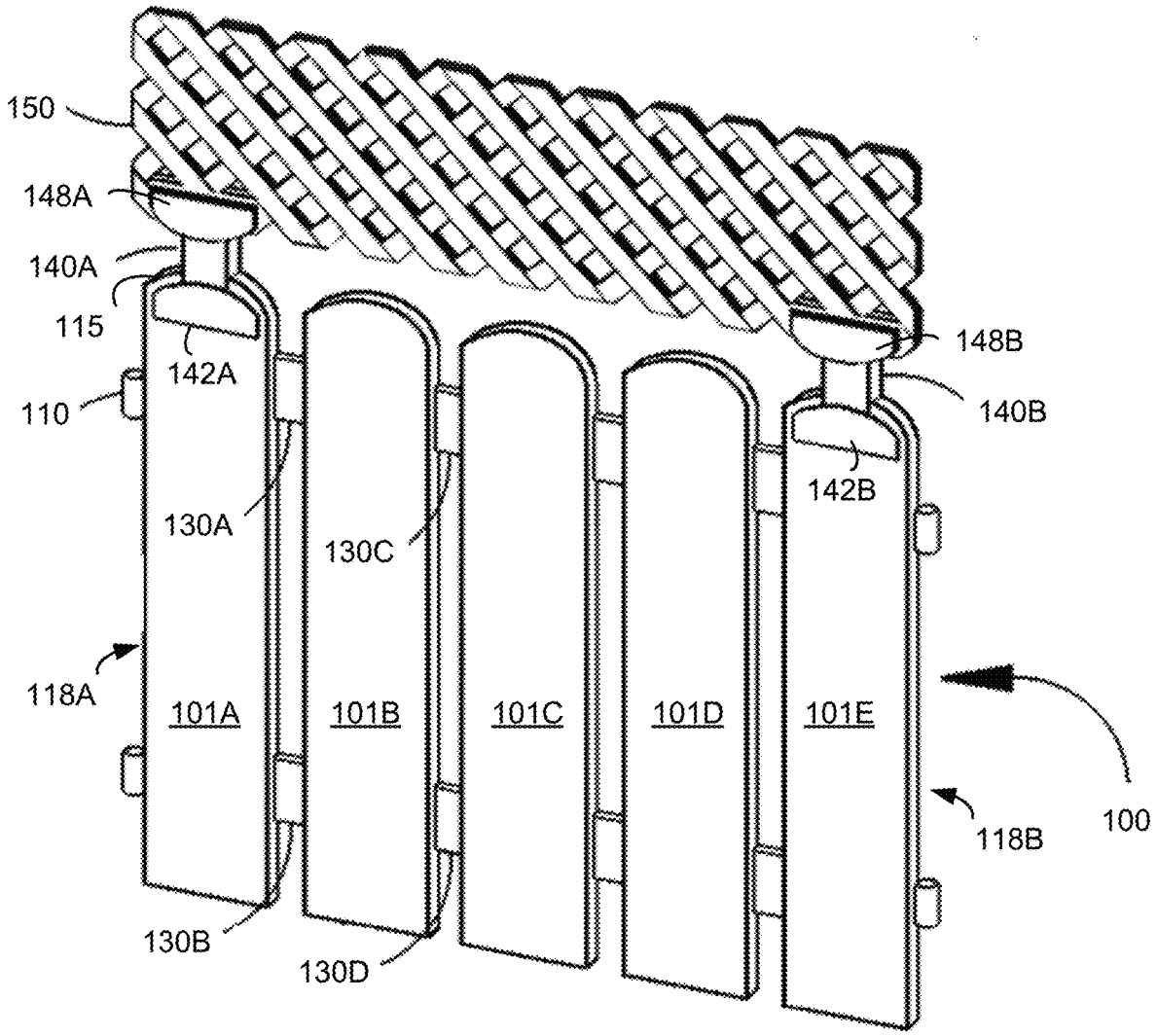
FIG. 1 illustrates a picket fence segment of a deployable fence, in accordance with some embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" "top," "bottom" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

The embodiments disclosed herein are related to a deployable fencing system. In one aspect, the fencing system includes two or more sets of pickets, and hinge knuckles coupled to the two or more sets of pickets. In some embodiments, a hinge knuckle may be coupled to a set of pickets by a protruding structure on the outer surface of the hinge knuckle corresponding to a portion of a hole on the set of pickets. In some embodiments, a hinge knuckle may include a cylindrical internal passage having a circumference at least the circumference of a hinge pin. In one aspect, the fencing system includes a double hinge pin including a first pin and a second pin conjoined together (e.g., the heads of two hinge pins may be conjoined such that the two hinge pins can be parallel to each other). In one aspect, the first pin of the double hinge pin may be inserted into a first hinge knuckle coupled to a first set of pickets. In one aspect, the second pin of the double hinge pin may be inserted into a second hinge knuckle coupled to a second set of pickets, interconnecting the second set of pickets with the first set of pickets. In some embodiments, the first set of pickets may be folded flat against the second set of pickets, in a stowage mode.

In some embodiments, the ends of pickets may include extendable levelers. The levelers may provide support on uneven ground (e.g., a sloping driveway). In some embodiments, the double hinge pin may include hinge pins of different lengths. Hence, the double hinge pin having different lengths can couple different sets of pickets on uneven ground.

Advantageously, by interconnecting sets of pickets with a double hinge pin, with a first hinge pin of the double hinge pin inserted into a first hinge knuckle coupled to a first set of pickets and a second hinge pin of the double hinge pin inserted into a second hinge knuckle coupled to a second set of pickets, the first set of pickets may fold flat against the second set of pickets. In one implementation, a plurality of sets of pickets may be interconnected by a plurality of double hinge pins inserted into a plurality of hinge knuckles coupled to a plurality of sets of pickets, enabling the plurality of interconnected sets of pickets to fold flat against each other and into a space-efficient accordion stack when stowed. In one implementation, the first set of pickets of the stack of interconnected sets of pickets may further be interconnected by a double hinge pin to a hinge knuckle attached to a wall, enabling stowage of the stack of interconnected sets of pickets against the wall and providing support to the first set of pickets of the interconnected sets of pickets when the interconnected sets of pickets are extended from the stack of interconnected sets of pickets. In one implementation, levelers can be coupled to or provided at ends of pickets. The levelers may be extended over uneven ground (e.g., a sloping driveway). By enabling the extension of interconnected sets of pickets with extendable levelers, with the first set of pickets of the interconnected sets of pickets further interconnected to a hinge knuckle attached to a wall, the interconnected sets of pickets may temporarily be extended and enclose an area (e.g., a driveway) to provide temporary privacy within the enclosed area. When privacy is no longer needed, the interconnected sets of pickets may be retracted into a space efficient accordion stack (e.g., in a garage).

FIG. 1 illustrates a fence section assembly 100 (also referred to as "picket fence segment 100"), in accordance with some embodiments. In some embodiments, a picket fence segment 100 includes a set of pickets 101A, 101B, 101C, 101D, 101E, hinge knuckles 110, support structures 130 (e.g., 130A, 130B,130C,130D), a first lattice holder 140A, a second lattice holder 140B, and a lattice 150. In some embodiments, each picket fence segment 100 can be fabricated as one piece (e.g., by molding), or fabricated as a plurality of pieces or components affixed to each other (e.g., with glue or other coupling mechanisms). In some embodiments, the picket fence segment 100 includes more, fewer, or different components than shown in FIG. 1. In one aspect, multiple sets of picket fence segments 100 can be daisy chained or connected in series to enclose areas with varying geometries.

In some embodiments, each picket 101 is a mechanical component or a structure that can divide an area or prevent a physical object from passing from one area to another. Each picket 101 may include or be made from plastic, polymers, aluminum, metal materials, metal alloys, wood, particle wood, and synthetic materials as well as non-hollow pickets. In some embodiments, each picket 101A may be hollow inside, such that each picket 101 can be lightweight. In some embodiments, each picket 101 may have a curved or shaped top end 115. In some embodiments, each picket 101 may have holes (not shown in FIG. 1) drilled into one or more sides 118 (e.g., 118A, 118B), through which one or more components can be inserted or affixed. In one example, hinge knuckles 110 can be coupled to a side of a picket 101A and a side of a picket 101E. In one example, support structures 130 can be coupled to one or more sides of the pickets 101A, 101B, 101C, 101D, 101E.

In some embodiments, a hinge knuckle 110 may be a mechanical component or structure to couple a set of pickets 101 to another set of pickets 101. A hinge knuckle 110 may include a cylindrical internal passage or opening, through which a pin can be inserted. The passage may have a circumference at least the circumference of a pin. In one configuration, one or more hinge knuckles 110 are coupled to a side 118A of the picket 101A (e.g., a wall of the picket 101A, a side wall of the picket 101A). In one configuration, one or more hinge knuckles 110 are coupled to a side 118B of the picket 101E. The hinge knuckle 110 may enable the interconnection of multiple sets of pickets 101 or multiple picket fence segments 100 via inserted double hinge pins, described below with respect to FIG. 12.

In some embodiments, a support structure 130 is a component that can couple one picket 101 to an adjacent picket 101 within a set of pickets 101. In some embodiments, two adjacent pickets 101 can be coupled to each other through two or more support structures 130. For example, pickets 101A, 101B can be coupled to each other through support structures 130A, 130B. The support structure 130A may connect an upper half portion of first picket 101A to a corresponding upper half portion of the picket 101B. The support structure 130B may connect a lower half portion of first picket 101A to a corresponding lower half portion of the picket 101B. The support structure 130A for connecting the upper portions of two adjacent pickets 101 and the support structure 130B for connecting the lower portions of two adjacent pickets 101 may have the same dimensions (e.g., thickness, widths, heights, etc.) or may have different dimensions.

In some embodiments, the first lattice holder 140A includes a picket end 142A to couple to the top end 115 of the picket 101A, and a lattice end 148A to couple to the lattice 150. In some embodiments, the second lattice holder 140B includes a picket end 142B to couple to the top end 115 of the picket 101E, and a lattice end 148B to couple to the lattice 150. In one aspect, the first lattice holder 140A and the second lattice holder 140B can be detachable from the pickets 101A, 101E by vertically pulling the first lattice holder 140A and the second lattice holder 140B up and away from the respective picket 101A, 101E.

In some embodiments, the lattice 150 is a mechanical component or a structure that can provide aesthetic features as well as additional privacy. In one aspect, the lattice 150 may have a width corresponding to a width of a set of pickets 101A, 101B, 101C, 101D, 101E. In one aspect, the lattice 150 can be detachable from the first lattice holder 140A and the second lattice holder 140B by vertically pulling the lattice 150 up and away from the lattice holders 140A, 140B.

Figure 2:
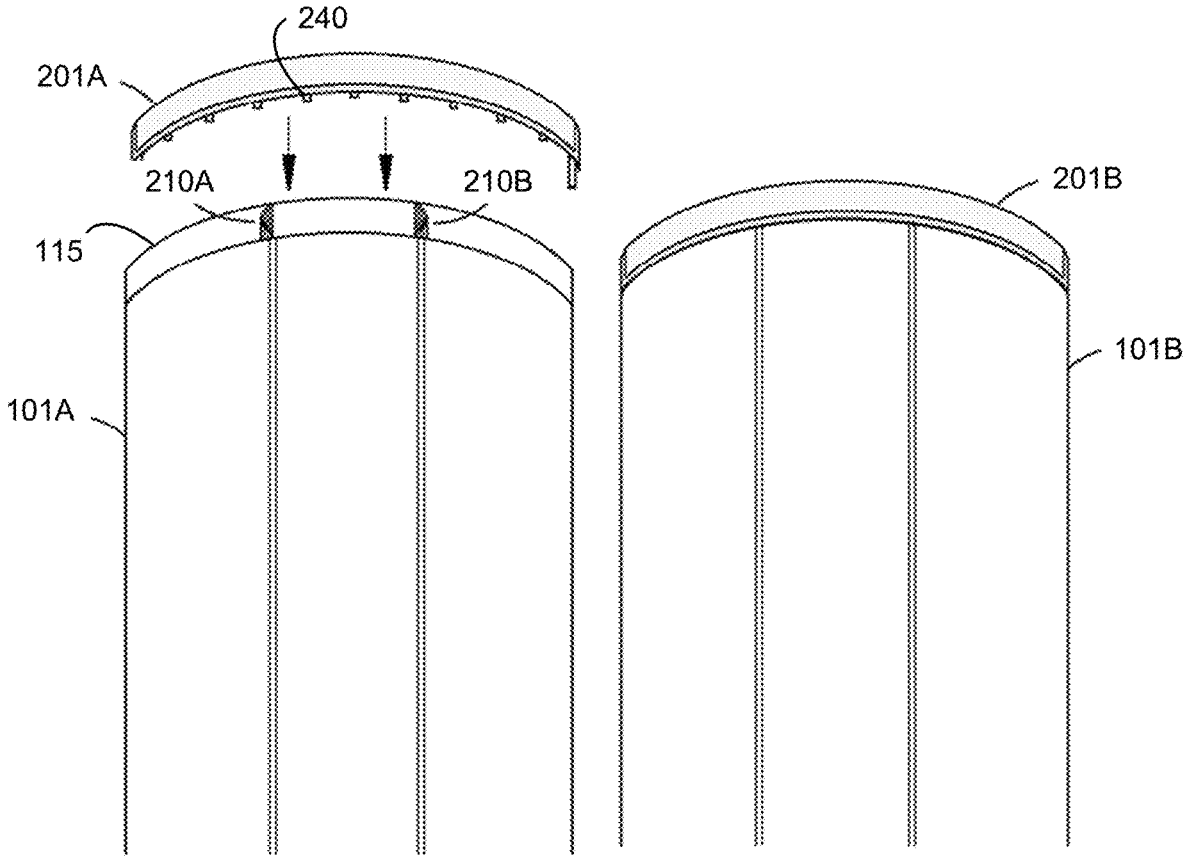
FIG. 2 illustrates a perspective view of top portions of pickets, in accordance with some embodiments.

FIG. 2 illustrates a perspective view of top portions of pickets 101A, 101B, in accordance with some embodiments. In some embodiments, a top end 115 of each picket 101 has a curved shape. Atop end 115 of each picket 101 can be covered by a picket cover 201 (e.g., 201A, 201B). A picket cover 201 may include or be made from the same material of the picket 101. A picket cover 201 may have a curved shape matching the shape of the top end 115 of the picket 101. The picket cover 201 may be detachable from the top end 115 of the picket 101. Hence, the picket cover 201 can be removed to couple or mount a lattice holder 140 to the top end 115 of the picket 101 or to access inside the picket 101. In one aspect, the picket 101 may have inner walls 210A, 210B within a hollow space of the picket 101. The picket cover 201 may have a plurality of bumps 240. The bumps 240 can be spaced apart by a distance corresponding to a separation between two inner walls 210A, 210B, such that the picket cover 201 can be secured or snapped onto the top end 115 of the picket 101A. For example, the bumps 240 can be spaced such that the bumps 240 do not contact the inner walls 210A, 210B when the picket cover is secured or snapped onto the top end 115 of the picket 101A.

Figure 3:
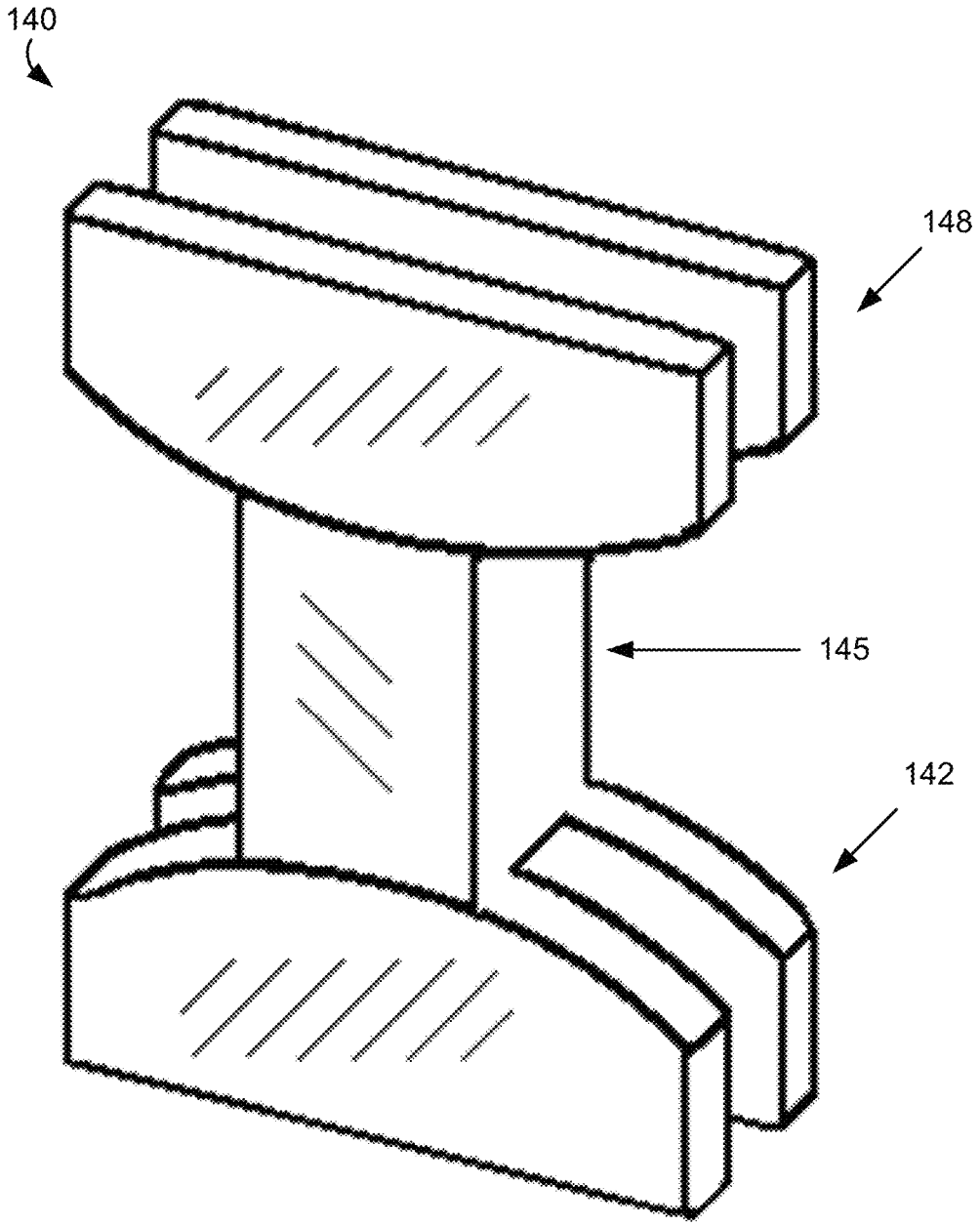
FIG. 3 depicts a perspective view of a lattice holder, in accordance with some embodiments.

FIG. 3 depicts a perspective view of a lattice holder 140, in accordance with some embodiments. In some embodiments, the lattice holder 140 includes a lattice holder body 145, a picket end 142, and a lattice end 148. The picket end 142 may be at a bottom of the lattice holder body 145. The picket end 142 may include two arms separated by a thickness of a picket 101. Hence, a picket 101 can be inserted into a space between two arms of the picket end 142, such that the picket 101 can be secured by the picket end 142. In some embodiments, the lattice end 148 may be at a top of the lattice holder body 145. The lattice end 148 may include two arms separated by a thickness of a lattice 150. Hence, a lattice 150 can be inserted into a space between two arms of the lattice end 148, such that the lattice 150 can be secured by the lattice end 148. In some embodiments, a thickness of a picket 101 and a thickness of a lattice 150 may be different. By implementing the lattice holders 140, privacy panels or lattices 150 having a different thickness than a set of pickets 101 can be placed on or secured to the top of the set of pickets 101.

Figure 4:
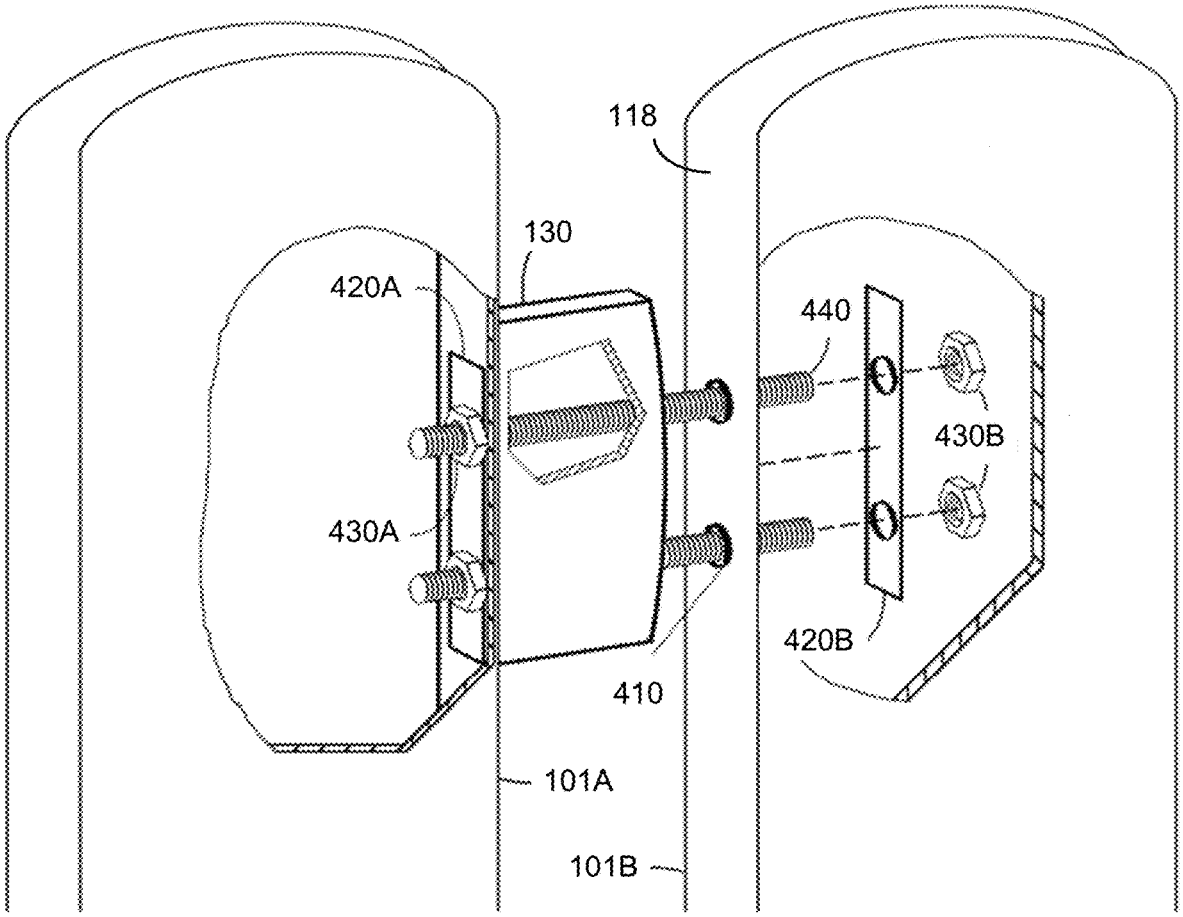
FIG. 4 depicts an open interior view of two pickets and a support structure coupling the two pickets, in accordance with some embodiments.

FIG. 4 depicts an open interior view of two pickets 101A, 101B and a support structure 130 coupling the two pickets 101A, 101B, in accordance with some embodiments. In some embodiments, the pickets 101A, 101B may have holes 410 on sides 118, and the support structure 130 may have corresponding holes or perforations. In one aspect, bolts 440 can be inserted through the holes 410 on the sides 118 of the pickets 101A, 101B, and through the holes or perforations of the support structure 130. In one aspect, a double hole bracket 420 can be placed on an inner side of the side 118. Nuts 430 may be coupled to the bolts 440 to couple the double hole brackets 420 and the pickets 101A, 101B to the support structure 130. The double hole bracket 420 and the nuts 430 can be provided inside the picket 101 by removing the picket cover 201. In some embodiments, washers can be implemented instead of a double hole bracket 420.

Figure 5:
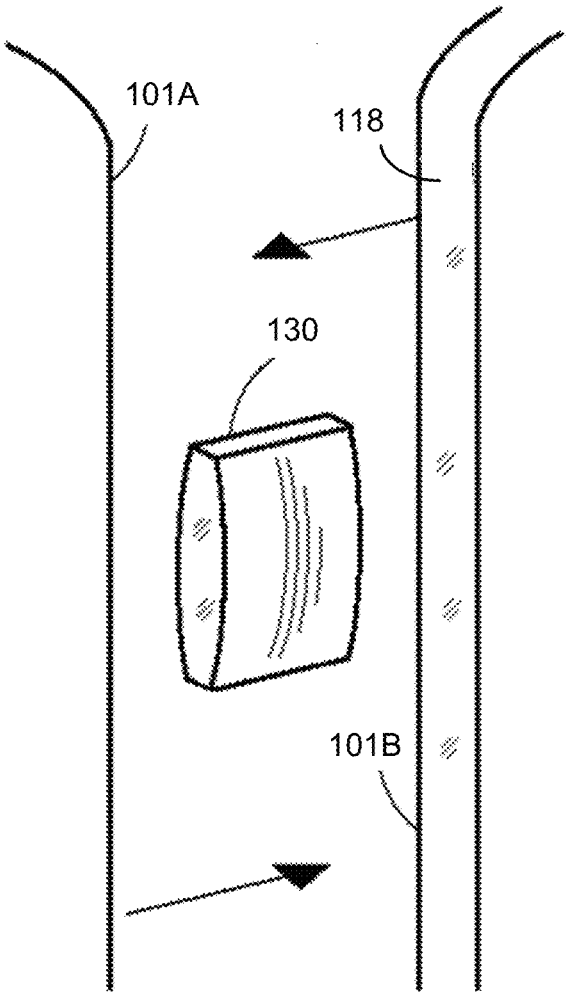
FIG. 5 depicts a perspective view of a support structure decoupled from two pickets, in accordance with some embodiments.

FIG. 5 depicts a perspective view of a support structure 130 decoupled from two pickets 101A, 101B, in accordance with some embodiments. In some embodiments, the support structure 130 can be coupled to sides 118 of the pickets 101A, 101B through chemical adhesion or thermal fusion.

Figure 6:
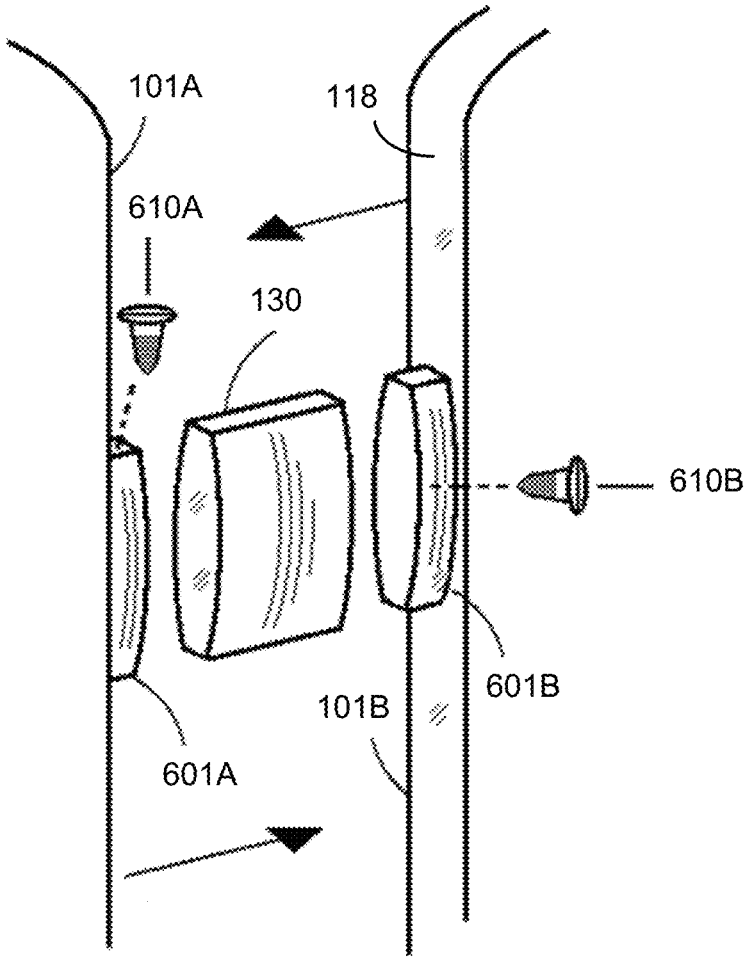
FIG. 6 depicts a perspective view of a support structure and support bracket covers, in accordance with some embodiments.

FIG. 6 depicts a perspective view of a support structure 130 and support bracket covers 601A, 601B, in accordance with some embodiments. In some embodiments, support bracket covers 601A, 601B may have a space, which a corresponding end portion of the support structure 130 can be slid into. For example, one end of the support structure 130 can be inserted or slid into a space within the support bracket cover 601A coupled to the side 118 of the picket 101A, and another end of the support structure 130 can be inserted or slid into a space within the support bracket cover 601B coupled to the side 118 of the picket 101B. Once inserted, the support structure 130 can be locked, glued, fastened by screws 610A, 610B, thermally fused, or chemically adhered to the support bracket covers 601A, 601B.

Figure 7:
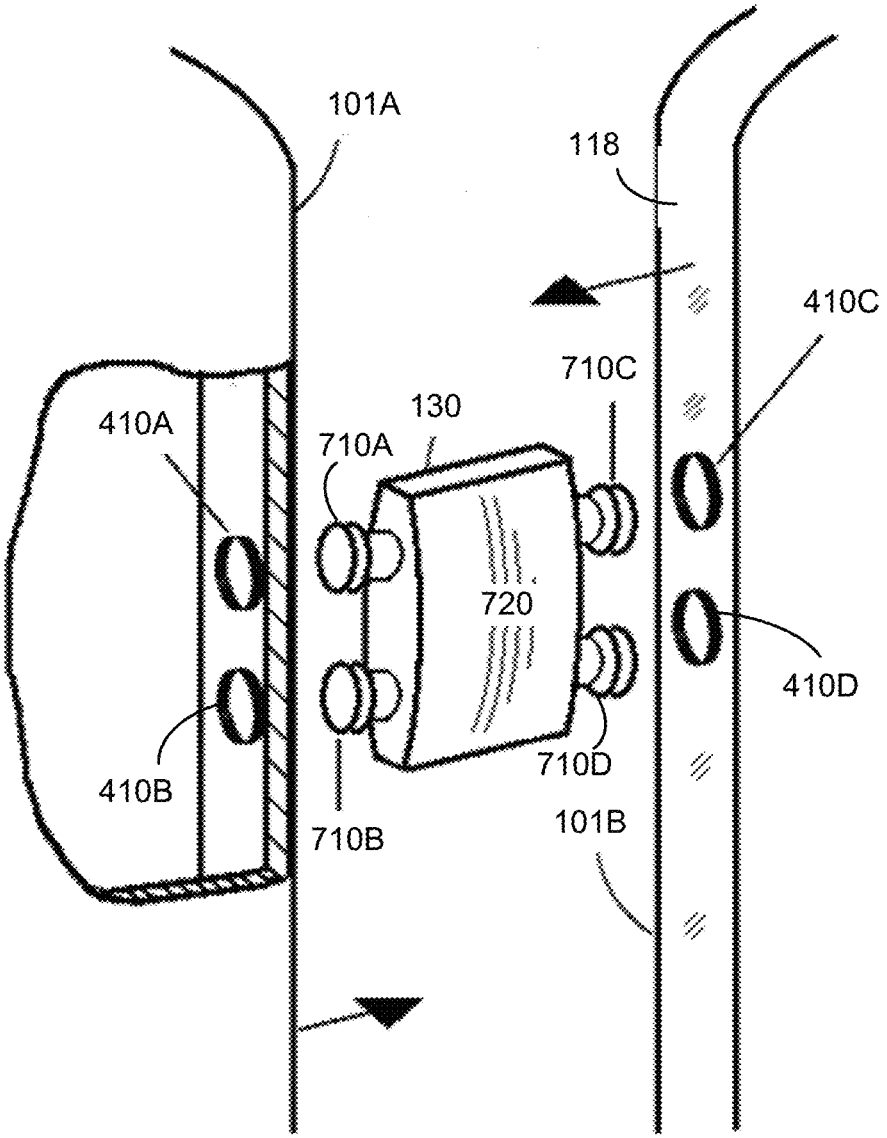
FIG. 7 depicts an open interior view of pickets and a support structure, in accordance with some embodiments.

FIG. 7 depicts an open interior view of pickets 101A, 101B and a support structure 130 that can be snapped onto the pickets 101A, 101B, in accordance with some embodiments. In some embodiments, the support structure 130 includes a body 720 and fixtures 710A, 710B, 710C, 710D (e.g., structures) protruding from the body 720. The body 720 may include rigid materials, where fixtures 710 may include flexible materials (e.g., rubber or plastic). In some embodiments, the side 118 of the picket 101A has holes 410A, 410B, and the side 118 of the picket 101B has holes 410C, 410D. In one aspect, fixtures 710A, 710B may be separated by a distance corresponding to a distance or separation between two holes 410A, 410B of the picket 101A. In one aspect, fixtures 710C, 710D may be separated by a distance corresponding to a distance or separation between two holes 410C, 410D of the picket 101A. Each fixture 710 may have a circumference matching or corresponding to a circumference of a corresponding hole 410. Each fixture 710 may have a shape corresponding to a portion of a shape of a corresponding hole 410. In this configuration, the fixtures 710A, 710B can be inserted into the holes 410A, 410B on the side 118 of the picket 101A, and the fixtures 710C, 710D can be inserted into the holes 410C, 410D on the side 118 of the picket 101B, such that the support structure 130 can couple two pickets 101A, 101B together.

Figure 8:
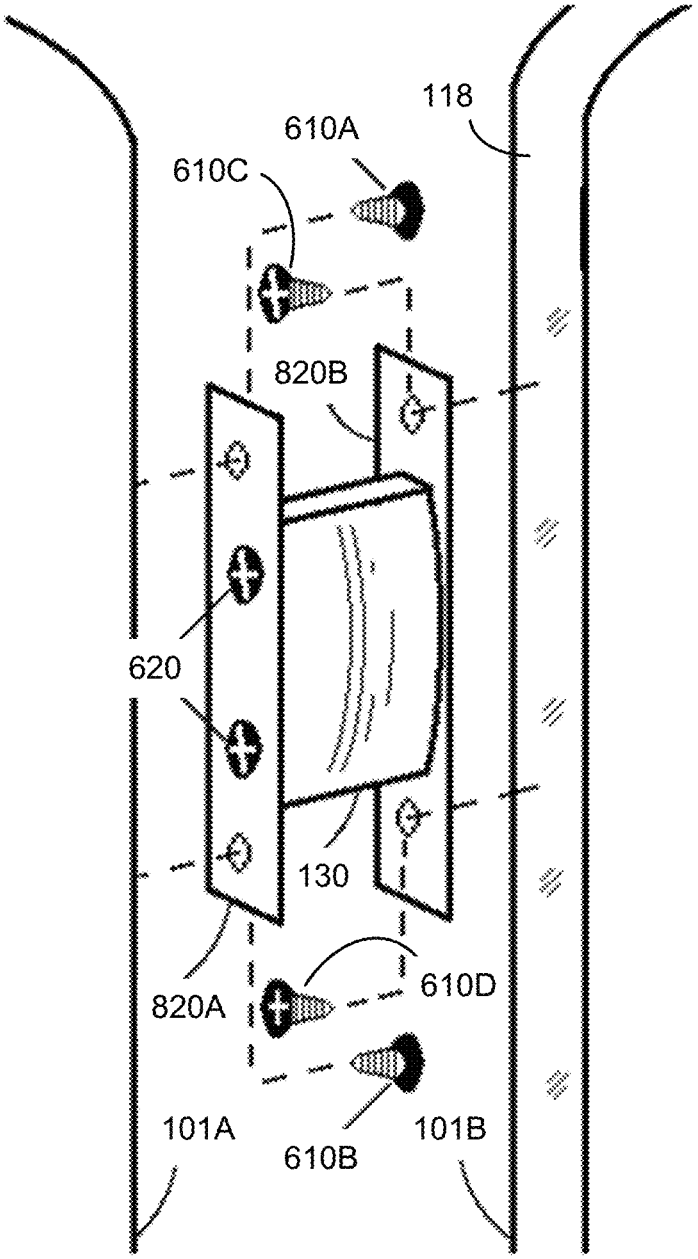
FIG. 8 depicts a perspective view of a support structure with external brackets, in accordance with some embodiments.

FIG. 8 depicts a perspective view of a support structure 130 with external brackets 820A, 820B, in accordance with some embodiments. In some embodiments, the external bracket 820A can be coupled to a side 118 of the support structure 130 facing the picket 101A through screws 620, and the external bracket 820B can be coupled to a side 118 of the support structure 130 facing the picket 101B through screws (not shown in FIG. 8). In one aspect, the external brackets 820A, 820B may include holes, through which screws 610A, 610B, 610D, 610D can be inserted. In this configuration, the screws 610A, 610B can be inserted through corresponding holes of the external bracket 820A to couple the support structure 130 to the side 118 of the picket 101A. Similarly, the screws 610C, 610D can be inserted through corresponding holes of the external bracket 820B to couple the support structure 130 to the side 118 of the picket 101B. In one aspect, the external brackets 820A, 820B can be provided externally to couple the support structure 130 to the pickets 101A, 101B, without accessing internal spaces of the pickets 101A, 101B. Although various screws 610, 620 are shown to couple the pickets 101A, 101B, the external brackets 820A, 820B, and the support structure 130, these components may be coupled to each other through other coupling mechanisms (e.g., mortise and tenon joint, lap joint, and biscuit joint, etc.).

Figure 9A:
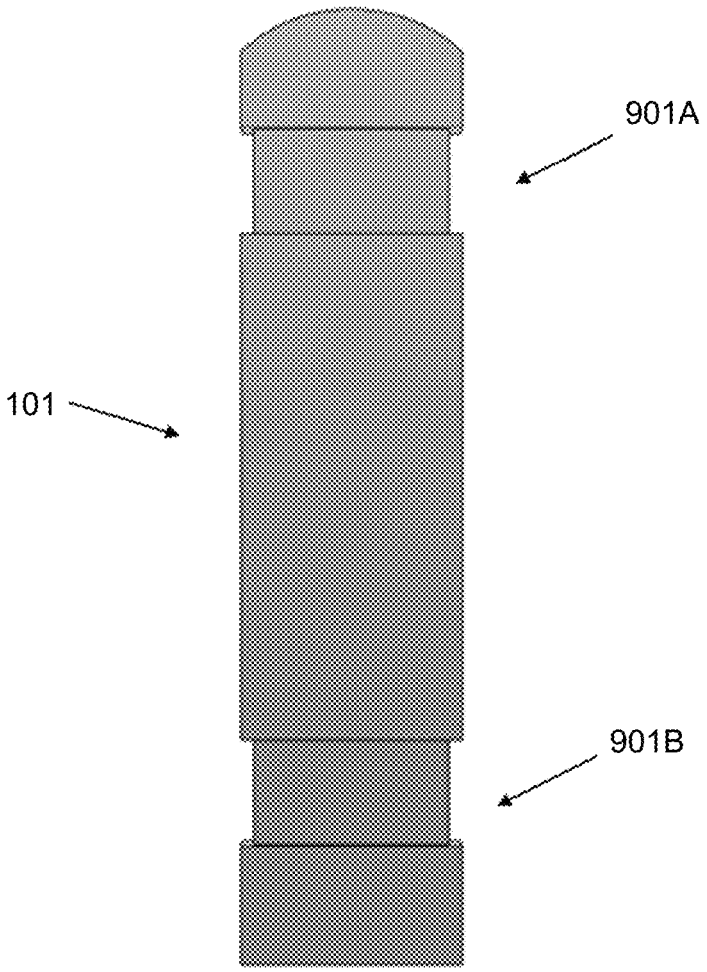
FIG. 9A depicts a front view of a picket, in accordance with some embodiments.
Figure 9B:
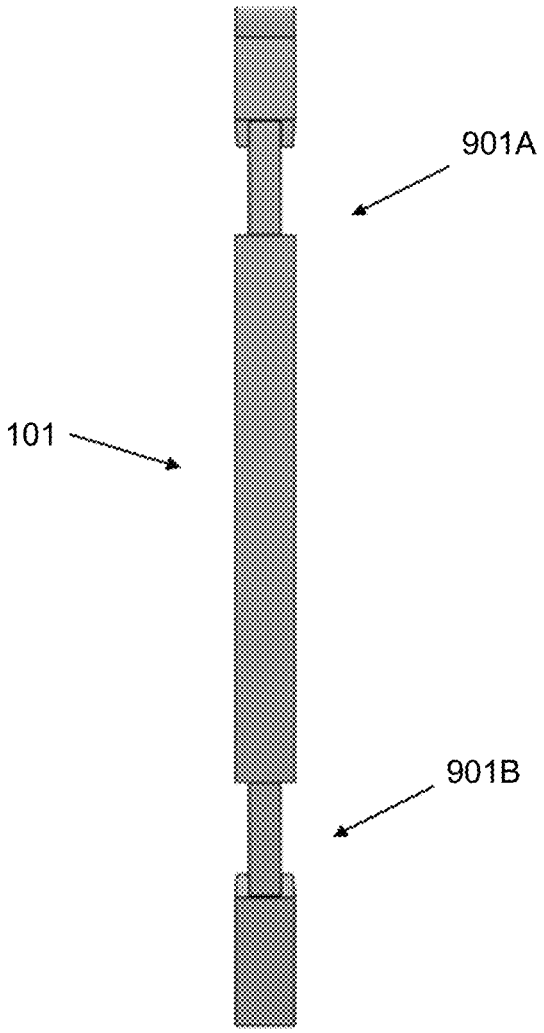
FIG. 9B depicts a side view of a picket, in accordance with some embodiments.
Figure 10:
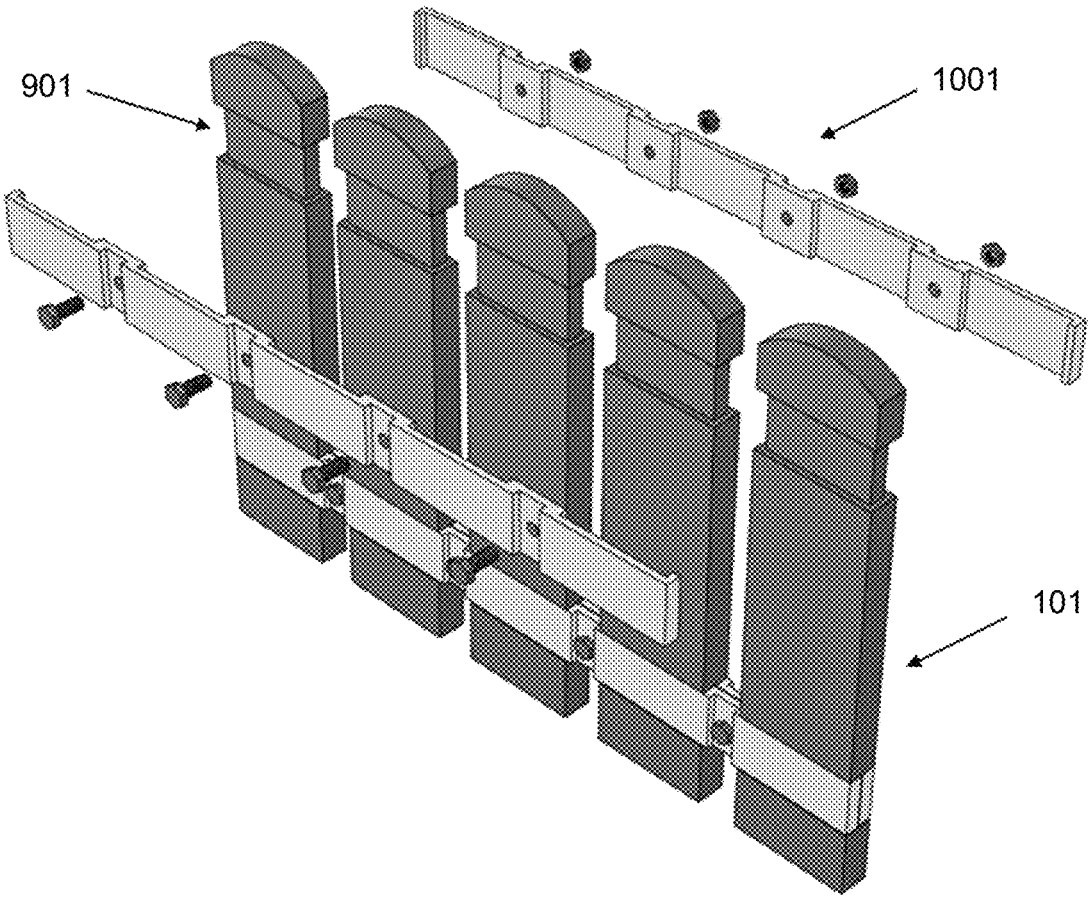
FIG. 10 depicts a partially exploded view of a picket fence segment of a deployable fence, in accordance with some embodiments.

FIG. 9A depicts a front view of a picket 101, in accordance with some embodiments. FIG. 9B depicts a side view of a picket 101, in accordance with some embodiments. FIG. 10 depicts a partially exploded view of a picket fence segment 100 of a deployable fence, in accordance with some embodiments. In some embodiments, pickets 101 can have one or more indentations 901A, 901B (e.g., recessed outer surfaces) at which straps 1001 (e.g., bars, rails, etc.) can fit. Straps 1001 (e.g., bars, rails, etc.) can be placed on the front and/or back sides of the pickets 101 to fit a space formed by indentations 901 of the pickets 101 to entrap the pickets 101. The straps 1001 (e.g., bars, rails, etc.) can be fastened with nuts and bolts to form one fence section (or a picket fence segment 100). In some embodiments, the strap 1001 (e.g., bar, rail, etc.) can be affixed by a latch or adhesives, instead of or in addition to nuts and bolts.

Figure 11:
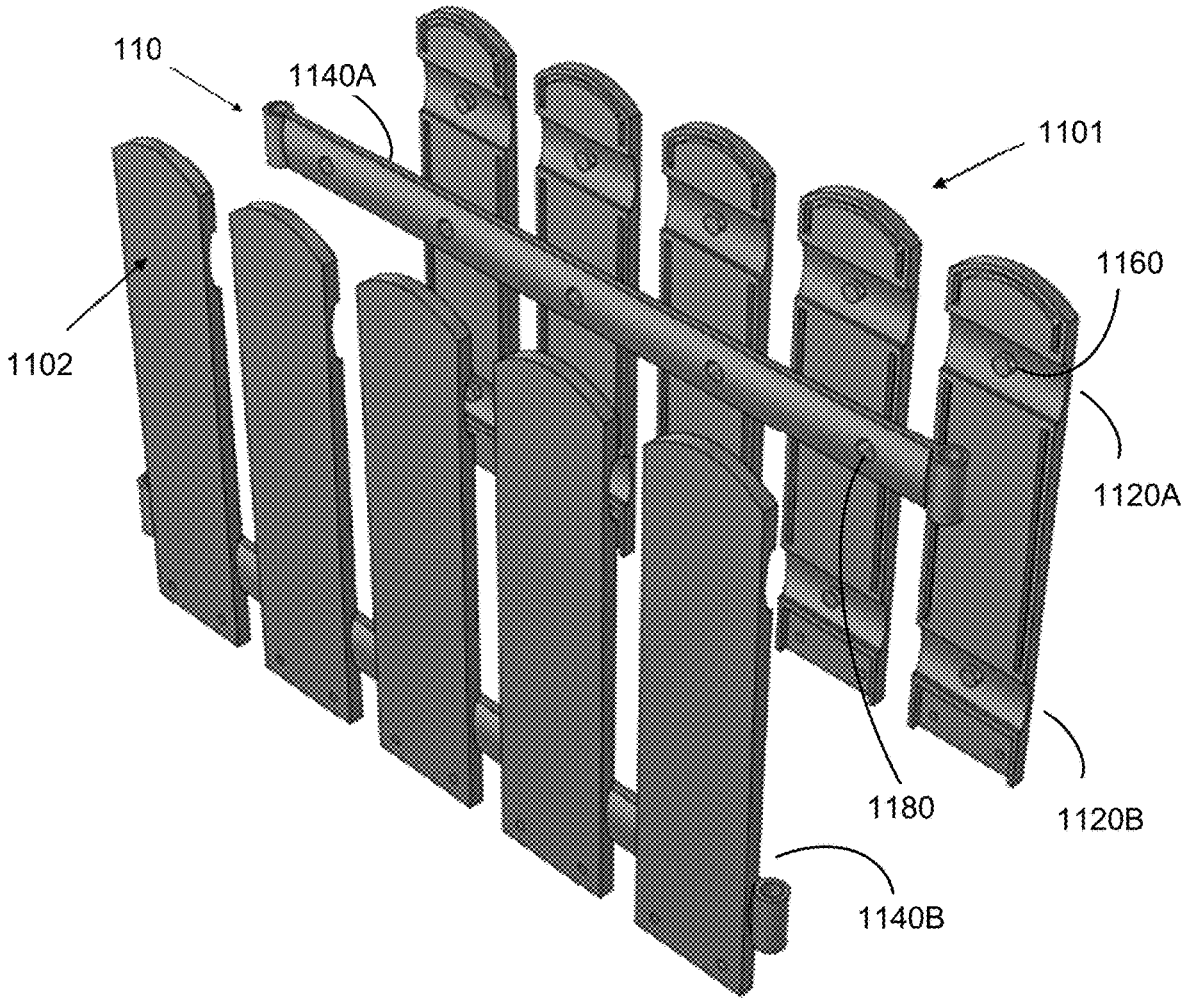
FIG. 11 depicts a partially exploded view of a picket fence segment of a deployable fence, in accordance with some embodiments.

FIG. 11 depicts a partially exploded view of a picket fence segment 100 of a deployable fence, in accordance with some embodiments. In some embodiments, each picket 101 can be formed by a front board 1102 and a back board 1101, as shown in FIG. 11. Each of the front boards 1102 and the back boards 1101 can include indentations 1120A, 1120B on an inner surface (e.g., recessed inner surfaces). When the front board 1102 and the back board 1101 are in contact with each other, spaces can be provided due to indentations 1120A, 1120B. In one aspect, bars 1140A, 1140B can be placed in spaces formed by the indentations 1120A, 1120B of the front boards 1102 and the back boards 1101. For example, the bar 1140A can be placed in spaces formed by indentations 1120A in a top portion of the front boards 1102 and the back boards 1101, and the bar 1140B can be placed in spaces formed by indentations 1120B in a bottom portion of the front boards 1102 and the back boards 1101. In some embodiments, each of the front boards 1102 and the back boards 1101 may include one or more protruding structures 1160 in the indentation. Each bar 1140 may have a plurality of holes 1180 having shapes matching shapes of the protruding structures 1160. In this configuration, front boards 1102 and corresponding back boards 1101 can be assembled or coupled to each other with the bar 1140 placed in spaces formed by indentations 1120 of the front boards 1102 and the back boards 1101 with protruding structures 1160 inserted into corresponding holes 1180 of the bar 1140. Hence, a picket fence segment 100 including a plurality of pickets 101 connected through one or more bars 1140 can be formed. In one aspect, hinge knuckles 110 can be formed on or coupled to one or both ends of the bar 1140.

In some embodiments, pickets or a fence segment including a set of pickets 101 shown in FIGS. 9A, 9B, 10, and 11 can be pre-manufactured. Embodiments of pre-manufactured pickets include but are not limited to pickets molded or extruded either as a single piece or as a plurality of pieces that are then pre-assembled.

Figure 12:
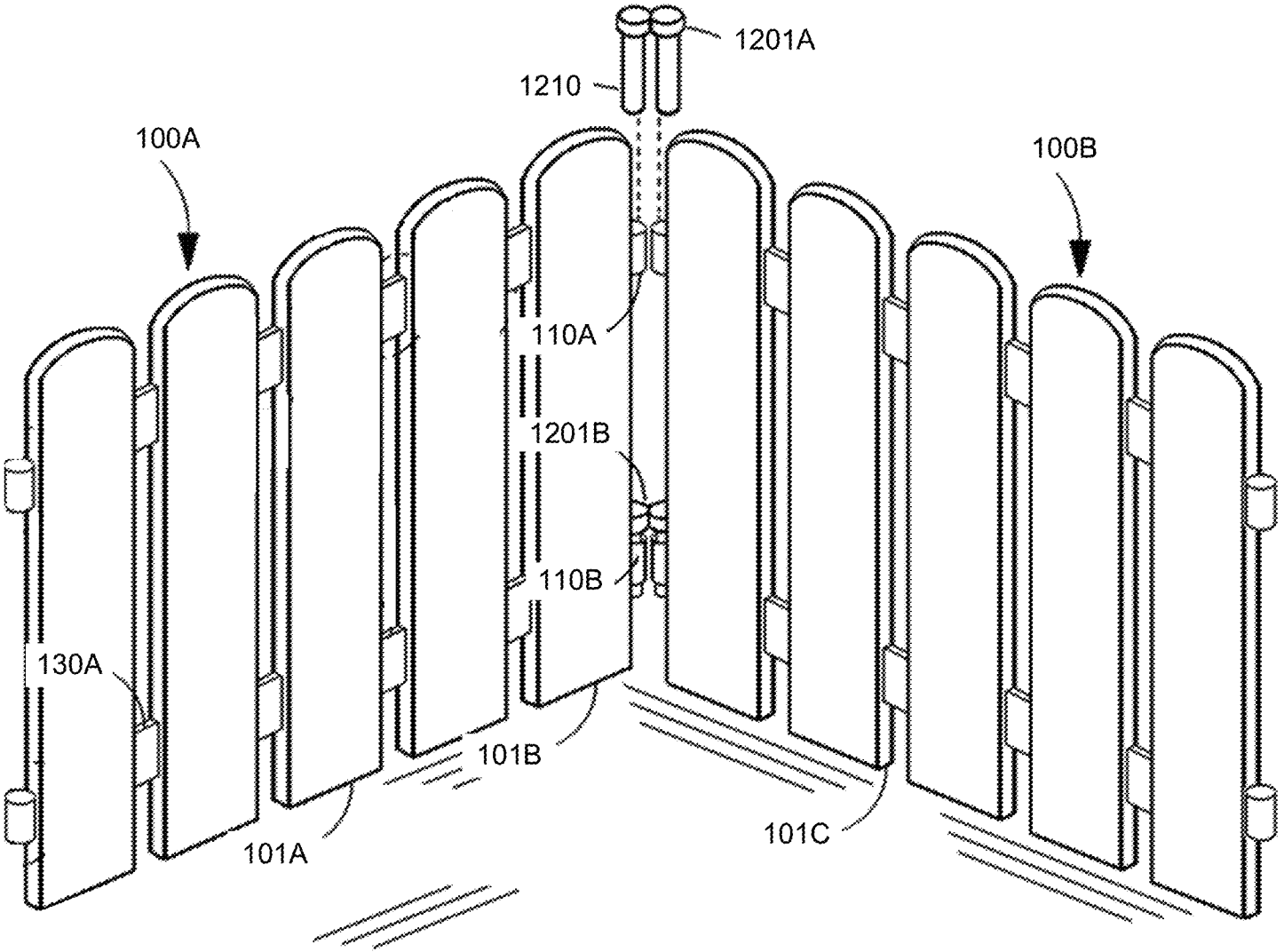
FIG. 12 depicts a perspective view of two picket fence segments with a hinge system, in accordance with some embodiments.

FIG. 12 depicts a perspective view of two picket fence segments 100A, 100B with hinge systems 1201A, 1201B on a flat surface, in accordance with some embodiments. In some embodiments, each of the picket fence segment 100 includes five pickets 101, where two adjacent pickets 101 are coupled to each other through two support structures 130. In some embodiments, two picket fence segments 100A, 100B can be coupled to each other through hinge systems 1201A, 1201B. In some embodiments, each picket fence segment 100 may include different number of pickets 101, and/or support structures 130 than shown in FIG. 12.

A hinge system 1201 may be embodied as a double hinge pin (also referred to as "conjoined head hinge pins 1201"). The double hinge pin can be made of a single fixture or multiple fixtures attached together. For example, the double hinge pin 1201 may include two pins 1210 connected or conjoined together at a first end (e.g., at heads of the pins 1210) and extending parallel to and spaced apart from each other away from the first end. The two pins can each be inserted into corresponding hinge knuckles 110 of two picket fence segments 100 such that the picket fence segments 100 may be rotatably coupled together. The length of pins 1210 may vary, such that the pins 1210 can be asymmetrical. Advantageously, because the two pins 1210 are spaced apart from each other (e.g., compared to a single pin extending through two vertically offset hinge knuckles 110 of two picket fence segments), the double hinge pin 1201 can allow up to 360 degrees of motion between any two interconnected picket fence segments 100, such that one picket fence segment 100 can be folded flat against an adjacent picket fence segment 100. Hence, a plurality of picket fence segments 100 can be folded or retracted like a space-efficient accordion stack. Accordingly, the plurality of picket fence segments 100 can be extended to enclose a large area in a fencing mode. In a stowage mode, the plurality of picket fence segments 100 can be folded flat in small area.

Figure 13:
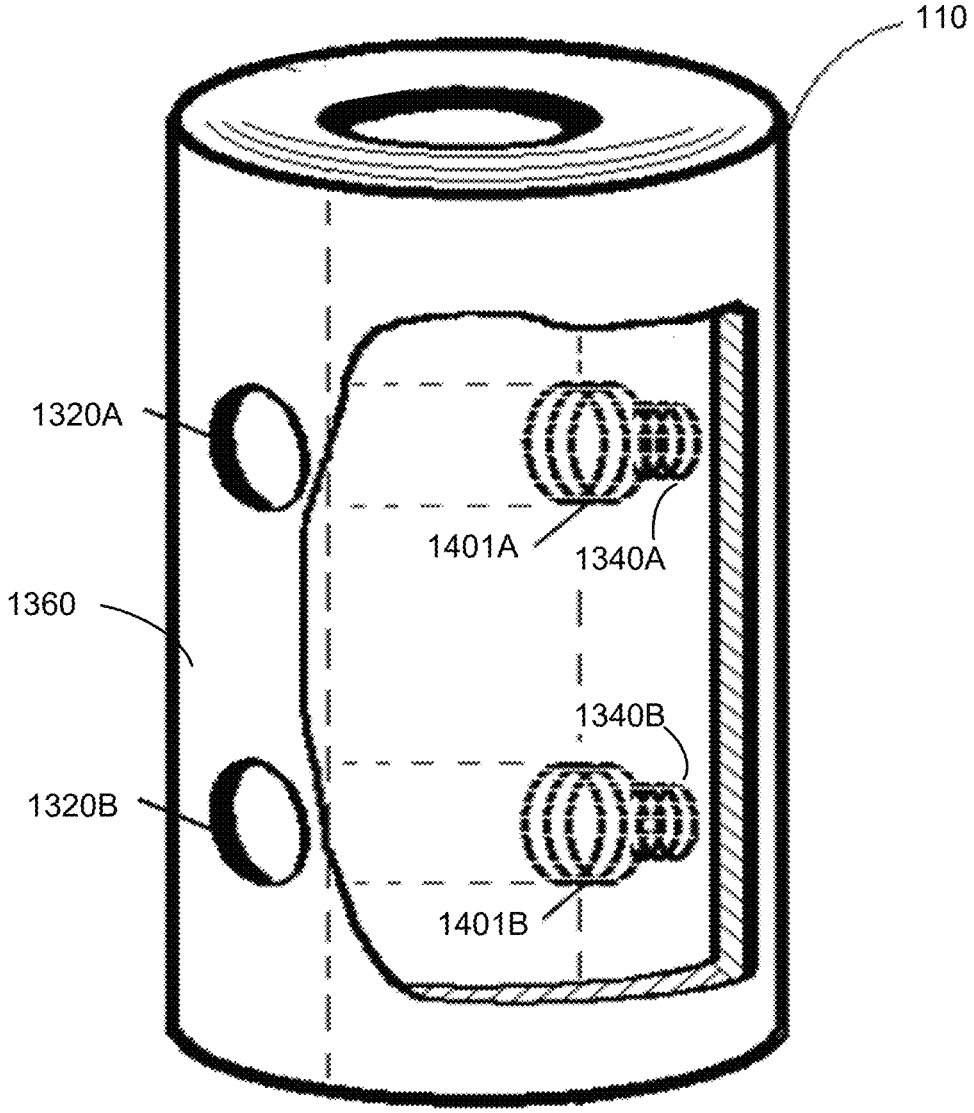
FIG. 13 depicts an open interior view of a hinge knuckle with assembly holes, in accordance with some embodiments.
Figure 14:
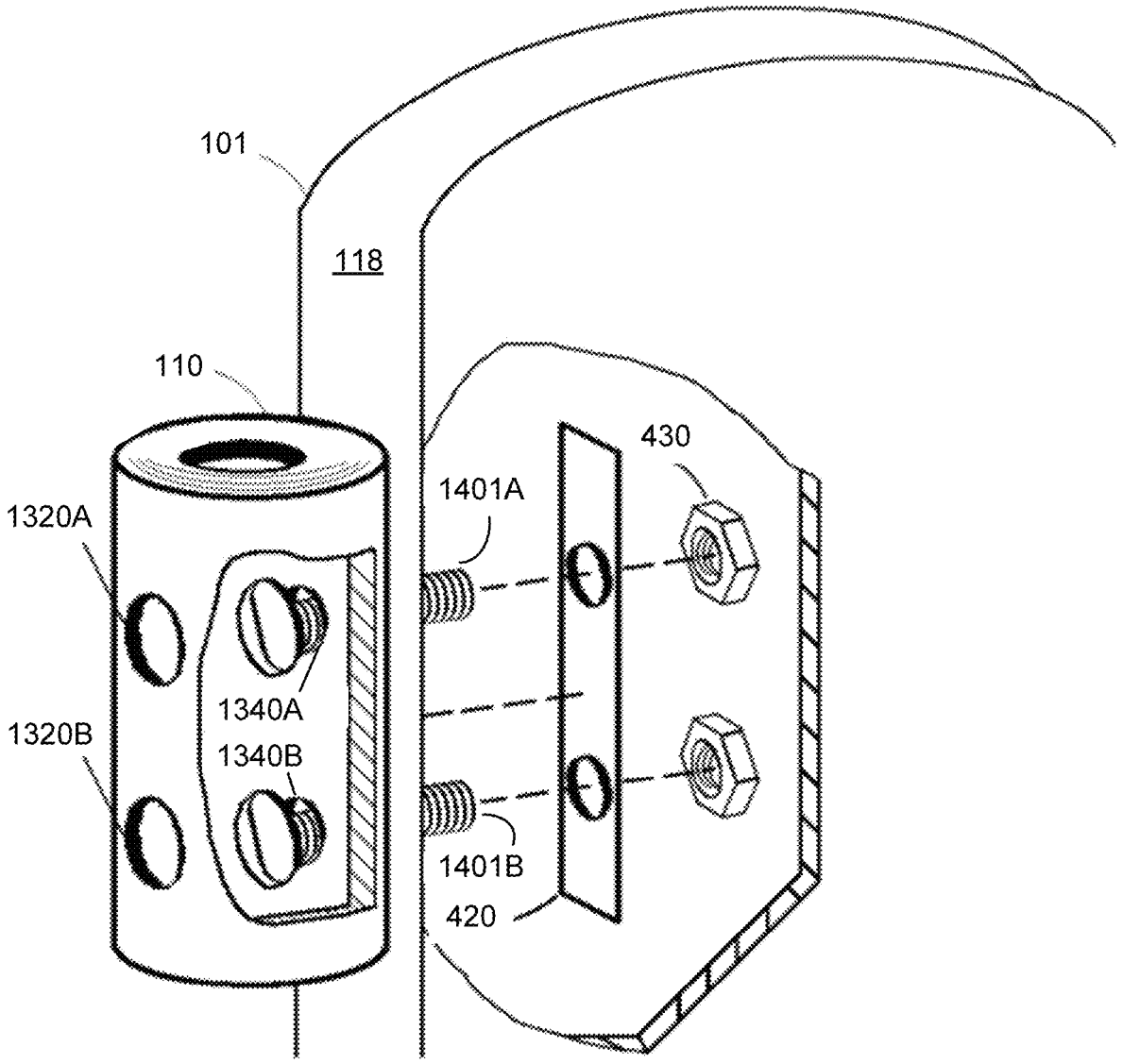
FIG. 14 depicts an open interior view of a hinge knuckle and a picket, in accordance with some embodiments.

FIG. 13 depicts an open interior view of a hinge knuckle 110 with assembly holes 1320A, 1320B, in accordance with some embodiments. FIG. 14 depicts an open interior view of a hinge knuckle 110 coupled to a picket 101, in accordance with some embodiments. In some embodiments, the hinge knuckle 110 can be coupled to the side 118 of the picket 101 through bolts 1401A, 1401B. For example, the hinge knuckle 110 may have a tubular shape or a cylindrical shape with holes 1320A, 1320B, 1340A, 1340B on a curved surface 1360. In one aspect, holes 1320A, 1320B may be provided on one side of the curved surface 1360, where holes 1340A, 1340B may be provided on an opposite side of the curved surface 1360. In some embodiments, the holes 1320A, 1320B may be larger than heads of the bolts 1401A, 1401B, but the holes 1340A, 1340B may be smaller than the heads of the bolts 1401A, 1401B, such that heads of the bolts 1401A, 1401B can be inserted or passed through the holes 1320A, 1320B but not through the holes 1340A, 1340B. In some embodiments, the double hole bracket 420 and the nuts 430 can be provided on an inner side of the side 118, such that bolts 1401A, 1401B can be fastened by the nuts 430 to secure the hinge knuckle 110 and the double hole bracket 420.

Figure 15:
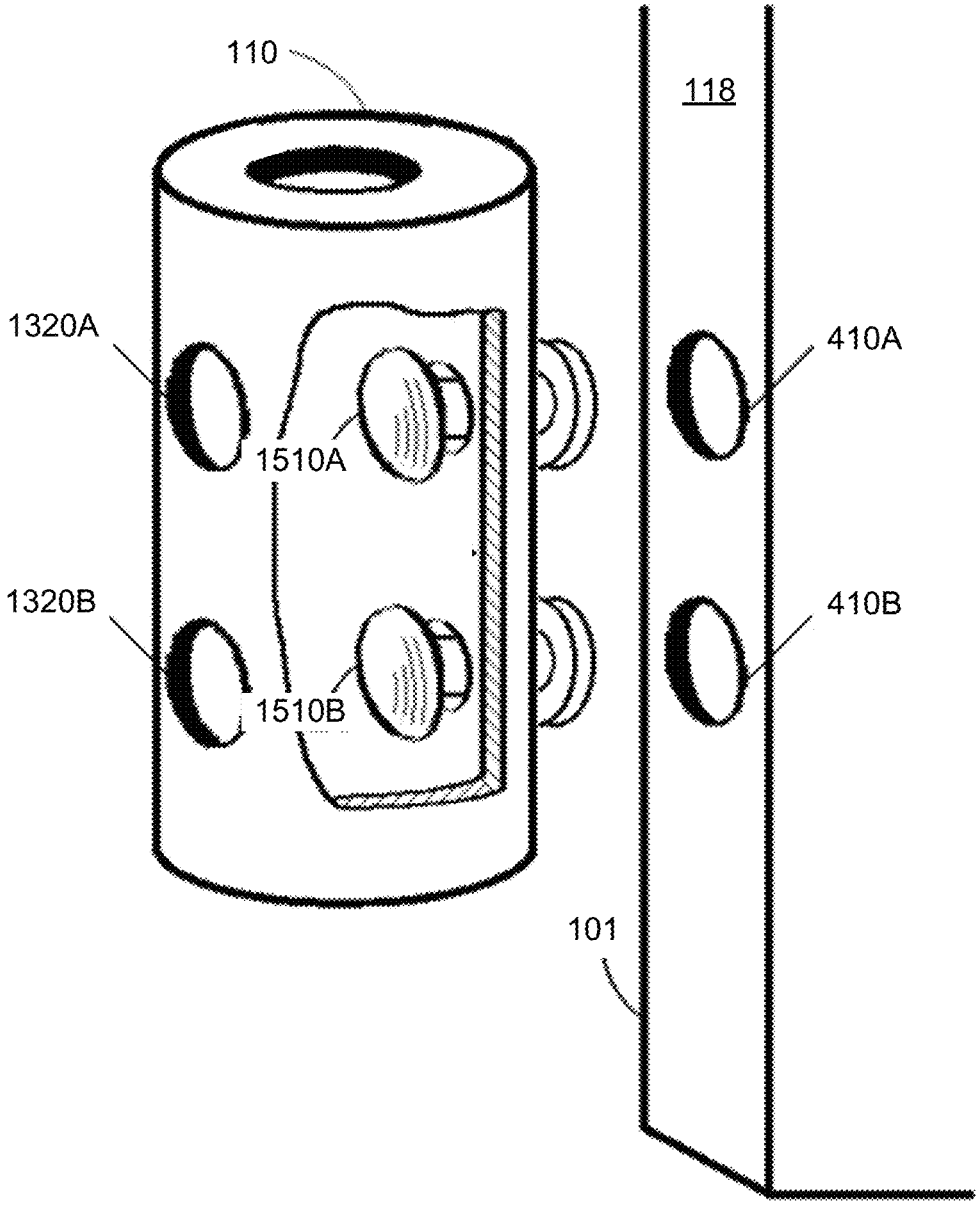
FIG. 15 depicts an open interior view of a hinge knuckle, in accordance with some embodiments.

FIG. 15 depicts an open interior view of a hinge knuckle 110, in accordance with some embodiments. In some embodiments, the hinge knuckle 110 can be coupled to the side 118 of the picket 101 by snap on fixtures 1510A, 1510B. The snap on fixtures 1510A, 1510B may include flexible materials (e.g., rubber or plastic) that can be inserted into corresponding holes 410A, 410B on the side 118 of the picket 101. In some embodiments, the hinge knuckle 110 can be coupled to the side 118 of the picket 101 through other mechanisms, such as self-locking screws, channel lock and interlocking keyways, etc.

Figure 16:
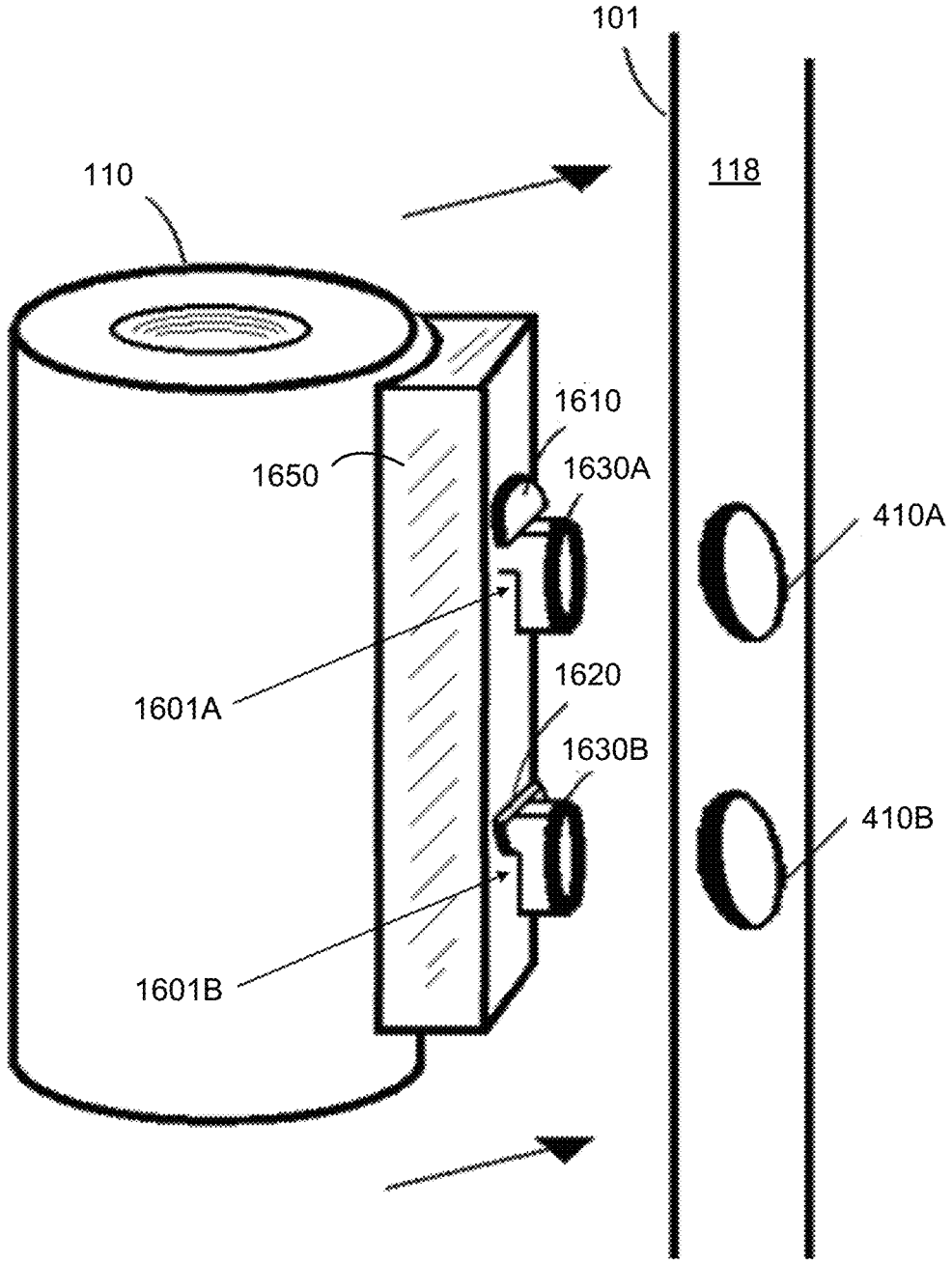
FIG. 16 depicts a perspective view of a hinge knuckle, in accordance with some embodiments.

FIG. 16 depicts one embodiment of a snap on hinge knuckle 110. In some embodiments, the hinge knuckle 110 includes or is coupled to an interface structure 1650, protruding structures 1610, 1620, and locking structures 1630A, 1630B.

In some embodiments, the interface structure 1650 can interface between a cylindrical shape of the hinge knuckle 110 and a planar surface of the side 118 of the picket 101. For example, the interface structure 1650 includes a curved surface corresponding to a cylindrical shape of the hinge knuckle 110 and a flat surface to contact or face the planar surface of the side 118 of the picket 101. On the planar surface of the interface structure 1650, protruding structures 1610, 1620 and the locking structure 1630A can be disposed. The protruding structures 1610, 1620 may be separated by a distance between two holes 410A, 410B. The protruding structure 1610 may have a top half circular shape, and the protruding structure 1620 may have a bottom half circular shape.

In some embodiments, the locking structure 1630A is disposed on the planar surface of the interface structure 1650 below the protruding structure 1610. The locking structure 1630A may have a raised surface having a circular shape that matches the shape of the hole 410A. The raised surface may be separated from the planar surface of the interface structure 1650 by a distance at least a thickness of the side 118 of the picket 101 to provide a space 1601A. In some embodiments, the locking structure 1630B is disposed on the protruding structure 1620. The locking structure 1630B may have a raised surface having a circular shape that matches the shape of the hole 410B. The raised surface may be separated from the planar surface of the interface structure 1650 by a distance at least a thickness of the side 118 of the picket 101 to provide a space 1601B.

Figure 17:
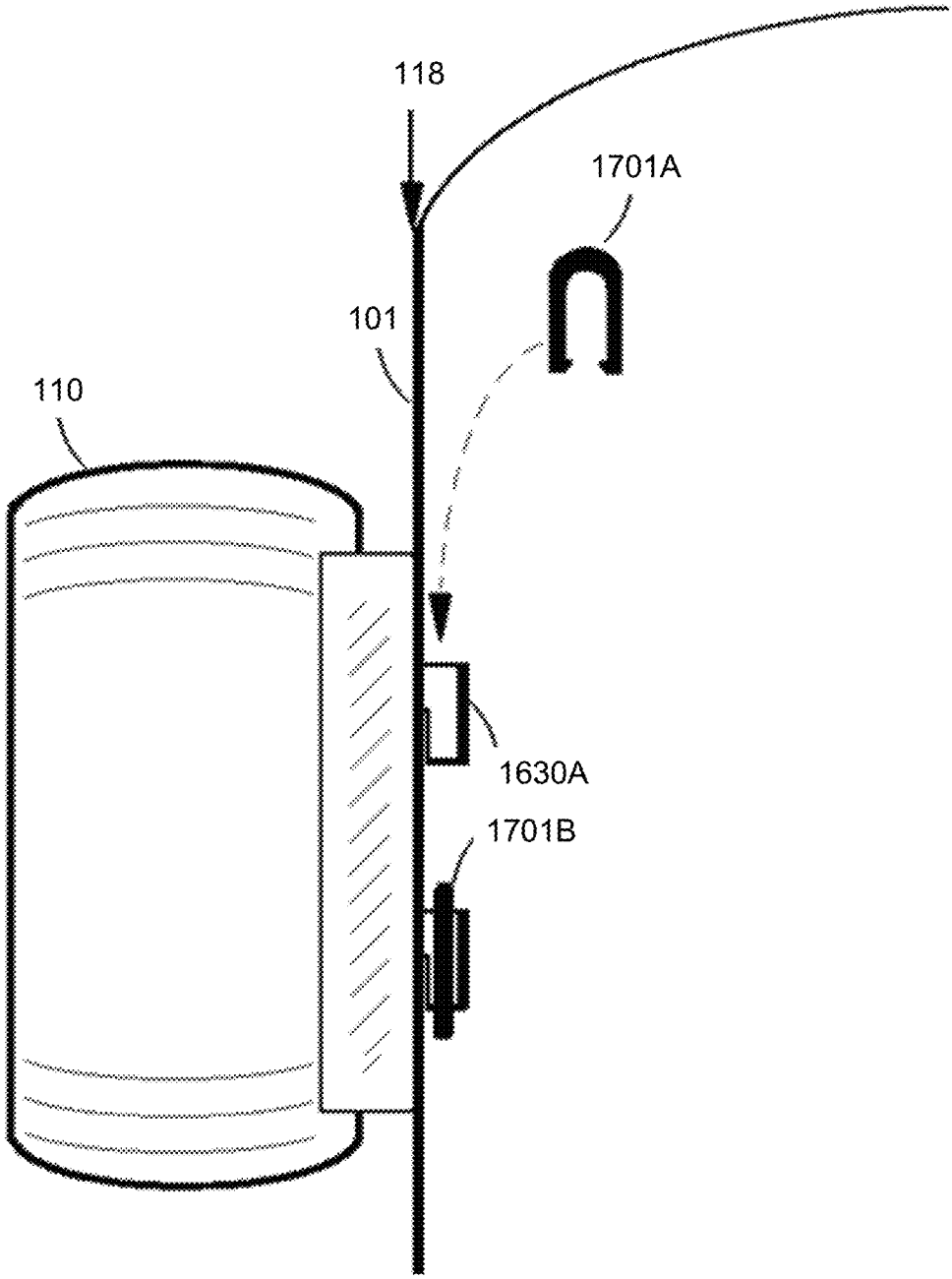
FIG. 17 depicts an open interior view of a hinge knuckle coupled to a picket with a retainer clip, in accordance with some embodiments.

In this configuration, the locking structures 1630A, 1630B can be inserted into the holes 410A, 410B of the side 118 of the picket 101, such that the hinge knuckle 110 can be snapped on or secured to the side 118 of the picket 101, as shown in FIG. 17. For example, the locking structures 1630A, 1630B can be inserted into the holes 410A, 410B along a lateral direction. Once the surface of the side 118 contacts the protruding structure 1610, the hinge knuckle 110 can be pushed downwards, such that the protruding structure 1610 having a top half circle shape can be inserted into the hole 410A and the protruding structure 1620 having a bottom half circle shape can be inserted into the hole 410B. After inserting the protruding structures 1610, 1620 to the holes 410A, 410B, respectively, retainer clips 1701A, 1701B can be provided around perimeters of raised surfaces of the locking structures 1630A, 1630B. Each retainer clip 1701 may have a horseshoe shape or a "U" shape. The retainer clips 1701A, 1701B can be provided by removing the picket cover 201. The retainer clips 1701A, 1701B may help secure the hinge knuckle 110 to the picket 101.

The protruding structure 1610 may be described as being located on a first portion of an outer surface of the hinge knuckle 110 (e.g., on a first portion of the flat planar surface). The protruding structure 1610 may have a shape corresponding to a shape of at least a portion of a shape of the hole 410A in the wall (e.g., the side 118) of the picket 101. For example, as discussed above, the first protruding structure 1610 may be semi-circular and the hole 410A may be circular. The corresponding locking structure 1630A may be described as having a first portion coupled to a second portion of the outer surface of the hinge knuckle 110 adjacent to the first portion of the outer surface of the hinge knuckle 110. The locking structure 1630A may have a second portion coupled to an end of the first portion and extending downward. The wall (e.g., the side 118) of the picket 101 may be inserted into a space between the locking structure 1630A and a third portion of the outer surface of the hinge knuckle 110 adjacent the second portion of the outer surface of the hinge knuckle 110. The second portion of the second portion of the locking structure 1630A may be separated from the planar outer surface of the hinge knuckle 110 by a distance greater than a thickness of the wall of the picket 101. The retainer clips 1701A, 1701B may have a perimeter larger than a circumference of the corresponding hole 410A, 410B. The second protruding structure 1620 on the planar outer surface of the hinge knuckle 110 may have a shape corresponding to a shape of a portion of the second hole 410B in the wall of the picket 101. The shape of the first protruding structure 1610 may be an upper half of a circle. The shape of the second protruding structure 1620 may be a lower half of a circle.

Figure 18:
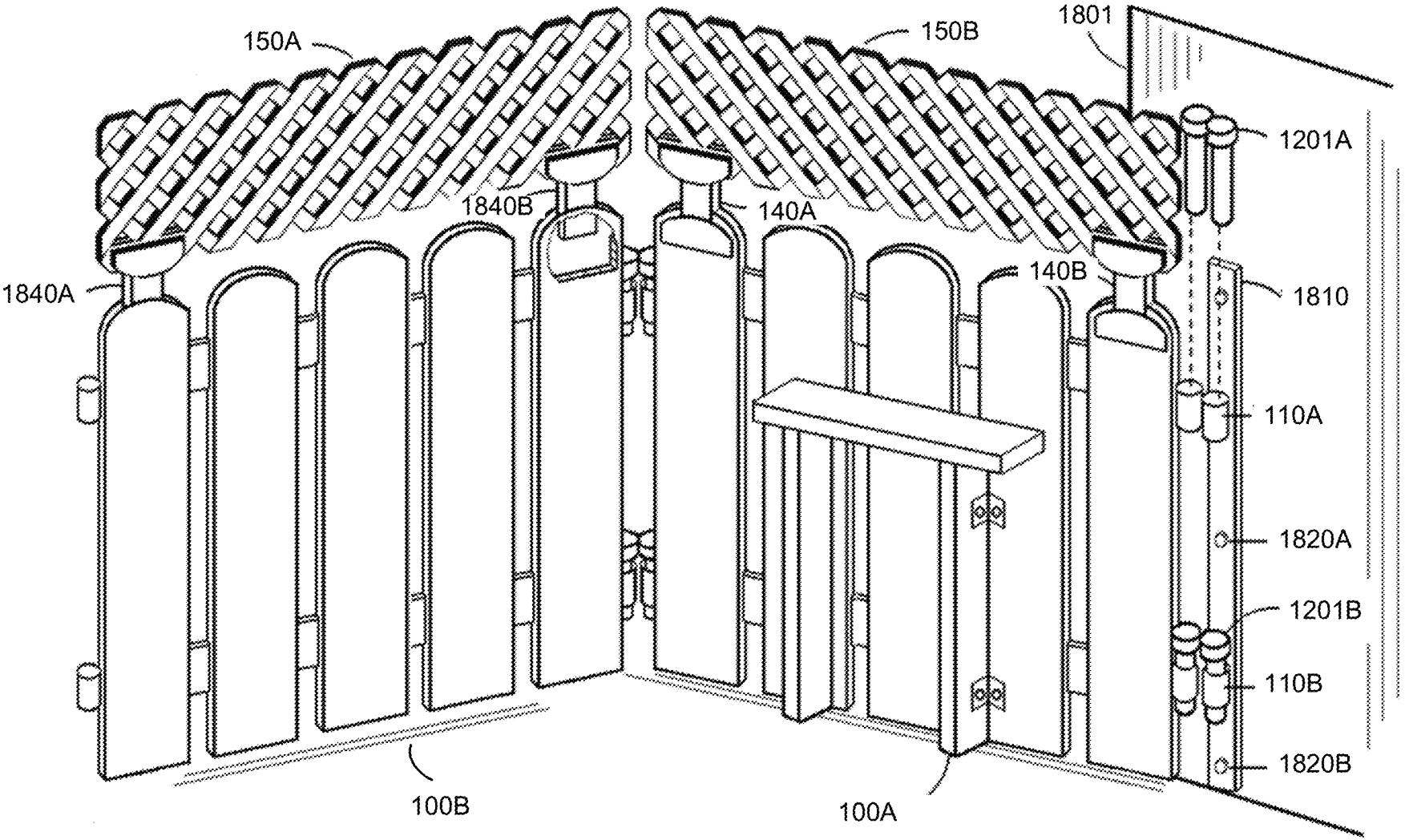
FIG. 18 depicts a perspective view of a picket fence segment coupled to a surface of a wall or a frame, in accordance with some embodiments.

FIG. 18 depicts a perspective view of a picket fence segment 100A coupled to a surface 1801 of a wall or a frame, in accordance with some embodiments. In some embodiments, a support structure 1810 can be mounted on the surface 1801 of the wall or a frame through screws 1820A, 1820B. The support structure 1810 may include or may be coupled to two hinge knuckles 110A, 110B, through which pins of double hinge pins 1201A, 1201B can be inserted to couple the picket fence segment 100A to the support structure 1810. Another picket fence segment 100B can be coupled to the picket fence segment 100A through corresponding double hinge pins, as described above with respect to FIG. 12. Moreover, additional picket fence segments can be daisy chained in a similar manner. In one aspect, the interconnected picket fence segments as a whole can gain stability through the interconnection to the support structure 1810.

In some embodiments, the lattices 150A, 150B can be optionally added to provide added privacy. In some embodiments, the lattice 150B can be coupled to the picket fence segment 100A through the lattice holders 140A, 140B, as described above with respect to FIG. 3. In some embodiments, the lattice 150A can be coupled to the picket fence segment 100B through the lattice holders 1840A, 1840B. The lattice holder 1840 may be similar to the lattice holder 140, except the lattice holder 1840 may lack a picket end 142 with two arms to attach to outer surfaces of the picket 101. Instead, in one aspect, a picket cover 201 of a picket 101 can be removed, and the lattice holder body 145 can be inserted into the hollow space within the picket 101. In some embodiments, the lattice holder 140 can be attached to or secured to the picket 101 by pins, fixtures, or other fasteners.

Figure 19:
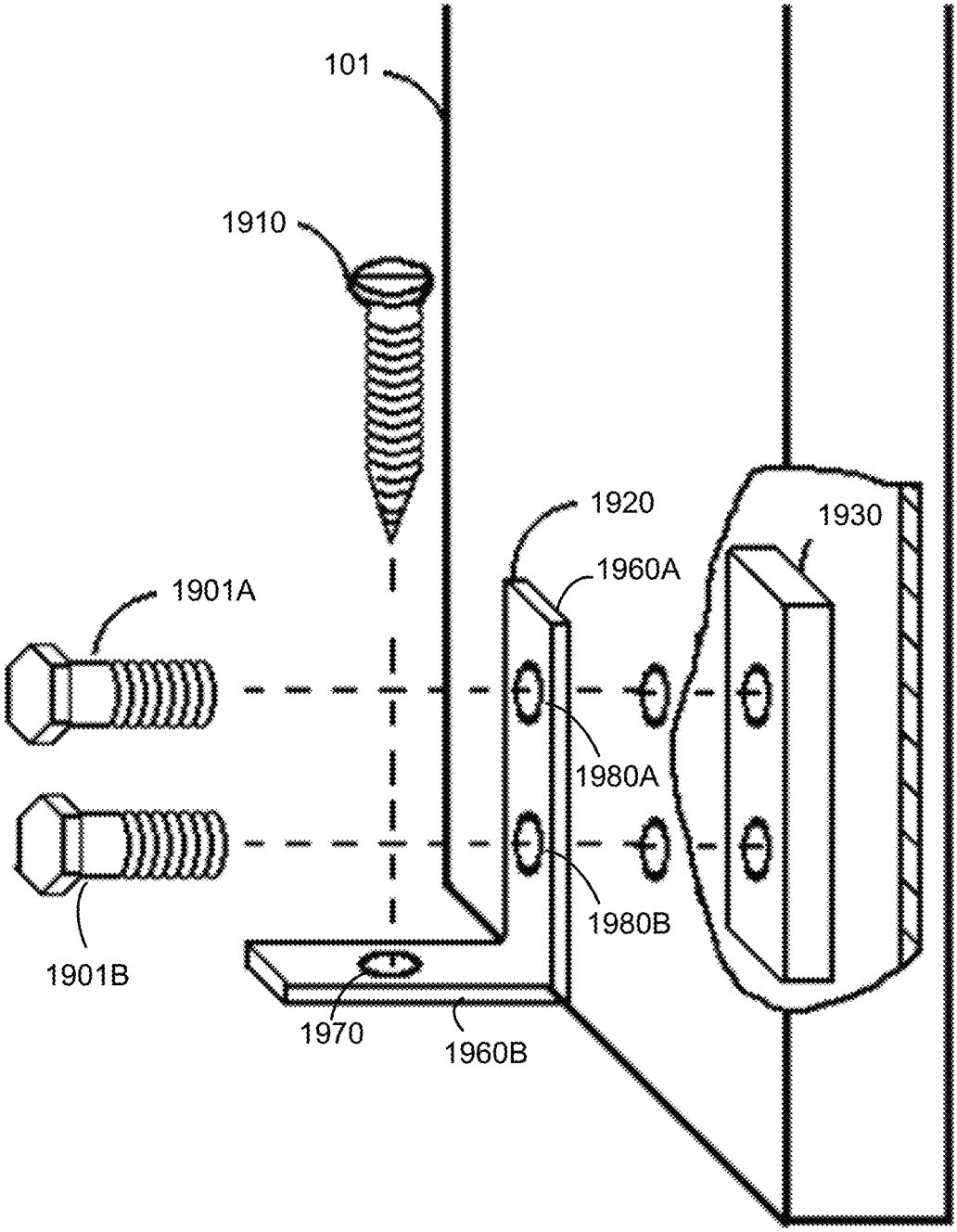
FIG. 19 depicts an open perspective view of a picket base and hardware for floor attachment, in accordance with some embodiments.

FIG. 19 depicts an open perspective view of a picket base and an L-shape bracket 1920 for floor attachment, in accordance with some embodiments. In some embodiments, the L-shape bracket 1920 may have a surface 1960A to face or contact the picket 101, and a surface 1960B to face or contact a floor. The surface 1960A may have holes 1980A, 1980B, and the surface 1960B may have a hole 1970. In this configuration, bolts 1901A, 1901B can be inserted through the holes 1980A, 1980B to secure the surface 1960A of the L-shape bracket 1920 to the picket 101. A double hole bracket 1930 can be also provided inside the picket 101 to secure the bolts 1901A, 1901B. In addition, a screw 1910 can be inserted through the hole 1970 to secure the surface 1960B of the L-shape bracket 1920 to the floor. Hence, the L-shape bracket 1920 can provide support to the picket 101. In some embodiments, other types of fasteners or components can be implemented to secure the L-shape bracket 1920 to the floor and/or the picket 101.

Figure 20:
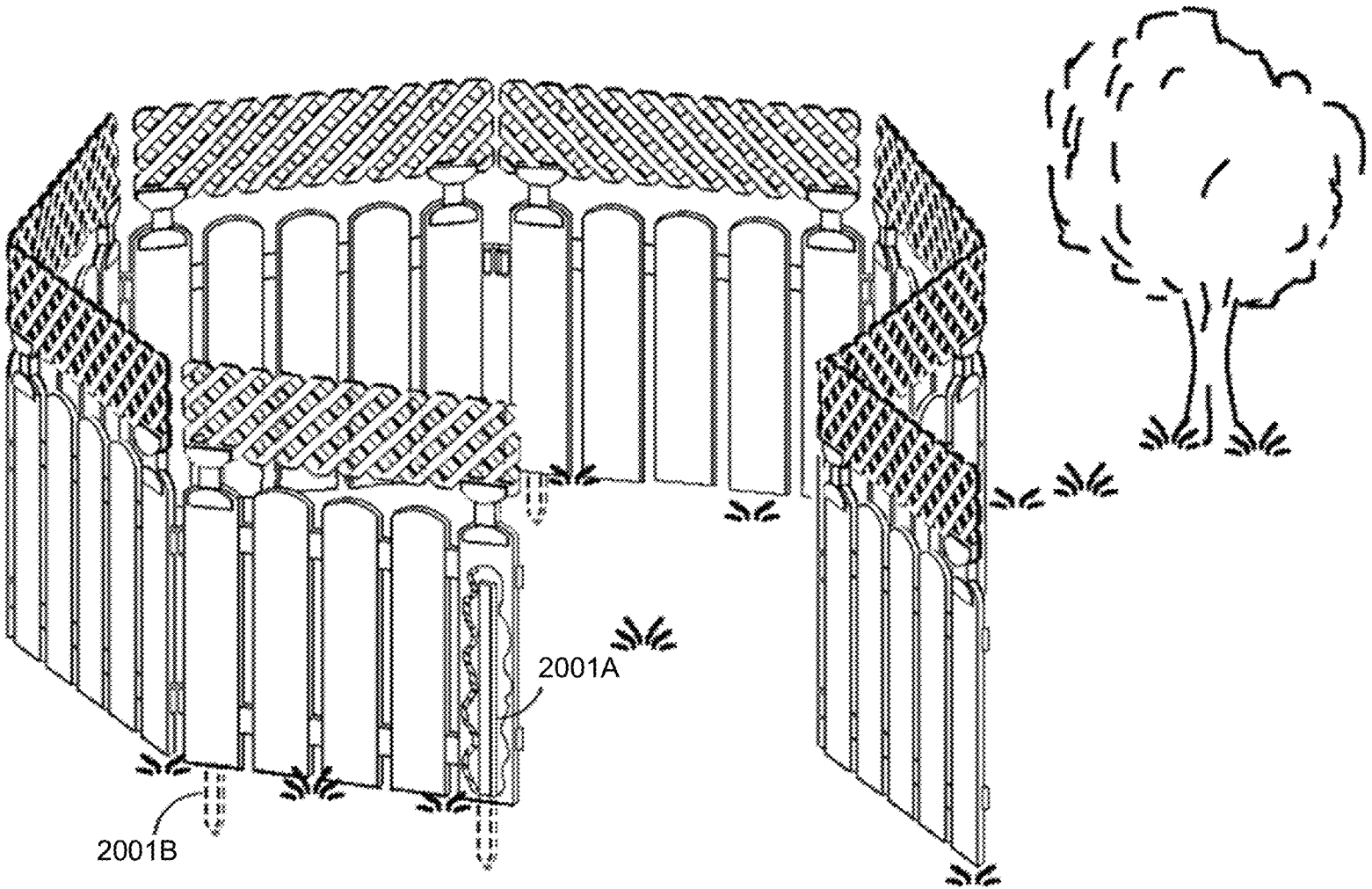
FIG. 20 depicts a perspective view of eight deployed picket fence segments with stakes for ground support, in accordance with some embodiments.

FIG. 20 depicts a perspective view of eight deployed picket fence segments 100 with stakes 2001 for ground support, in accordance with some embodiments. In some embodiments, ground stakes 2001 may extend from inside of the picket 101 out of an end of the picket 101 downward toward the ground (e.g., toward a surface of a ground). Ends of the stakes 2001 can be inserted into the ground to provide support to the pickets 101.

Figure 21:
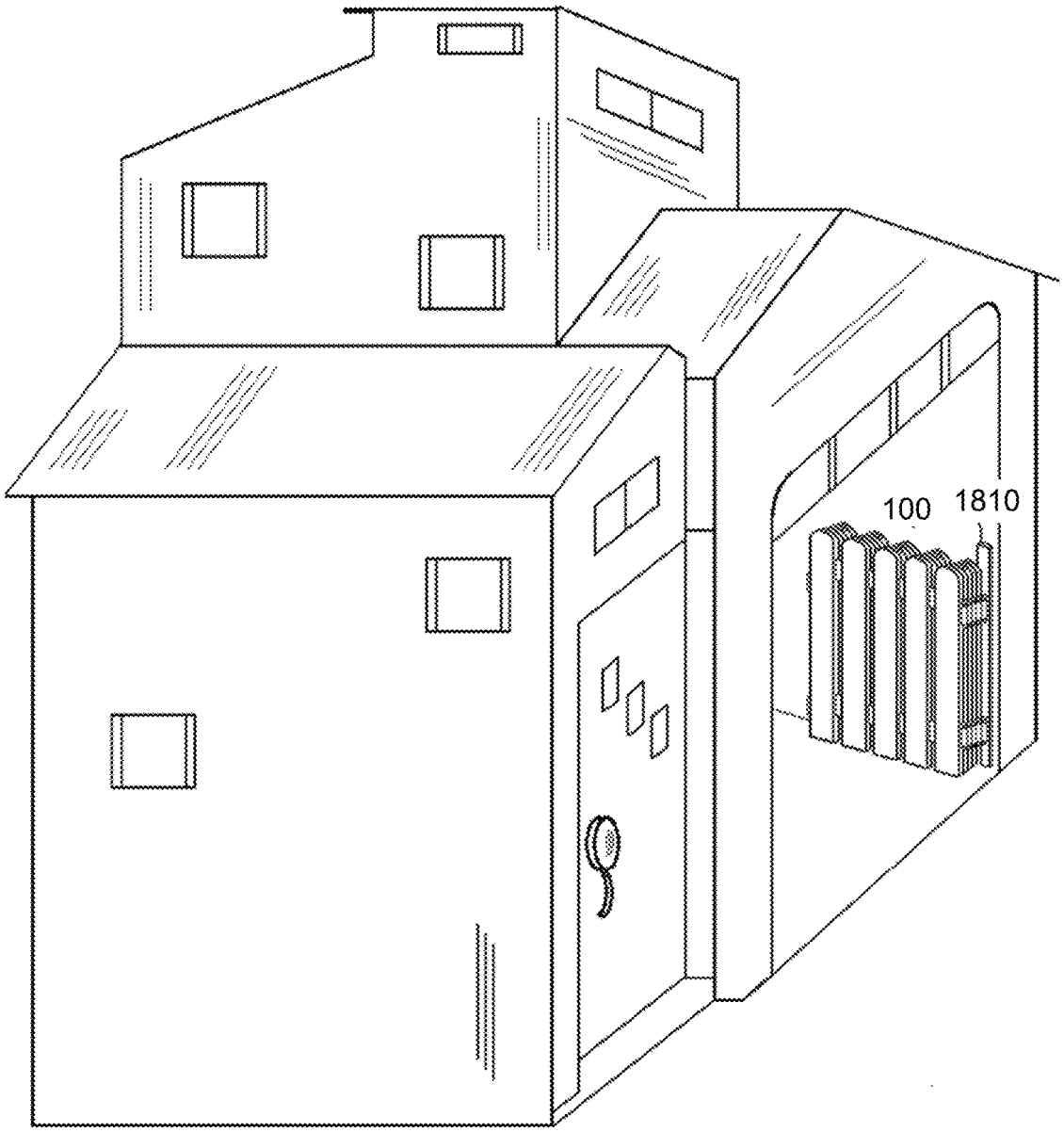
FIG. 21 depicts a perspective view of retracted fence segments, in accordance with some embodiments.

FIG. 21 depicts a perspective view of picket fence segments 100 folded in a stowage mode, in accordance with some embodiments. In one aspect, an end of a first picket fence segment 100 can be coupled or attached to a wall of a garage door, a frame of a garage door by one or more double hinge pins 1201 and one or more hinge knuckles 110. Another end of the first picket fence segment 100 can be coupled to an end of the second picket fence segment 100 by one or more additional double hinge pins 1201 and one or more additional hinge knuckles 110. Remaining ones of the plurality of picket fence segments 100 can be coupled or daisy chained, in a similar manner. In one aspect, the plurality of picket fence segments 100 may lay flat against each other when the plurality of picket fence segments 100 are retracted as a collapsed accordion as shown in FIG. 21.

Figure 22:
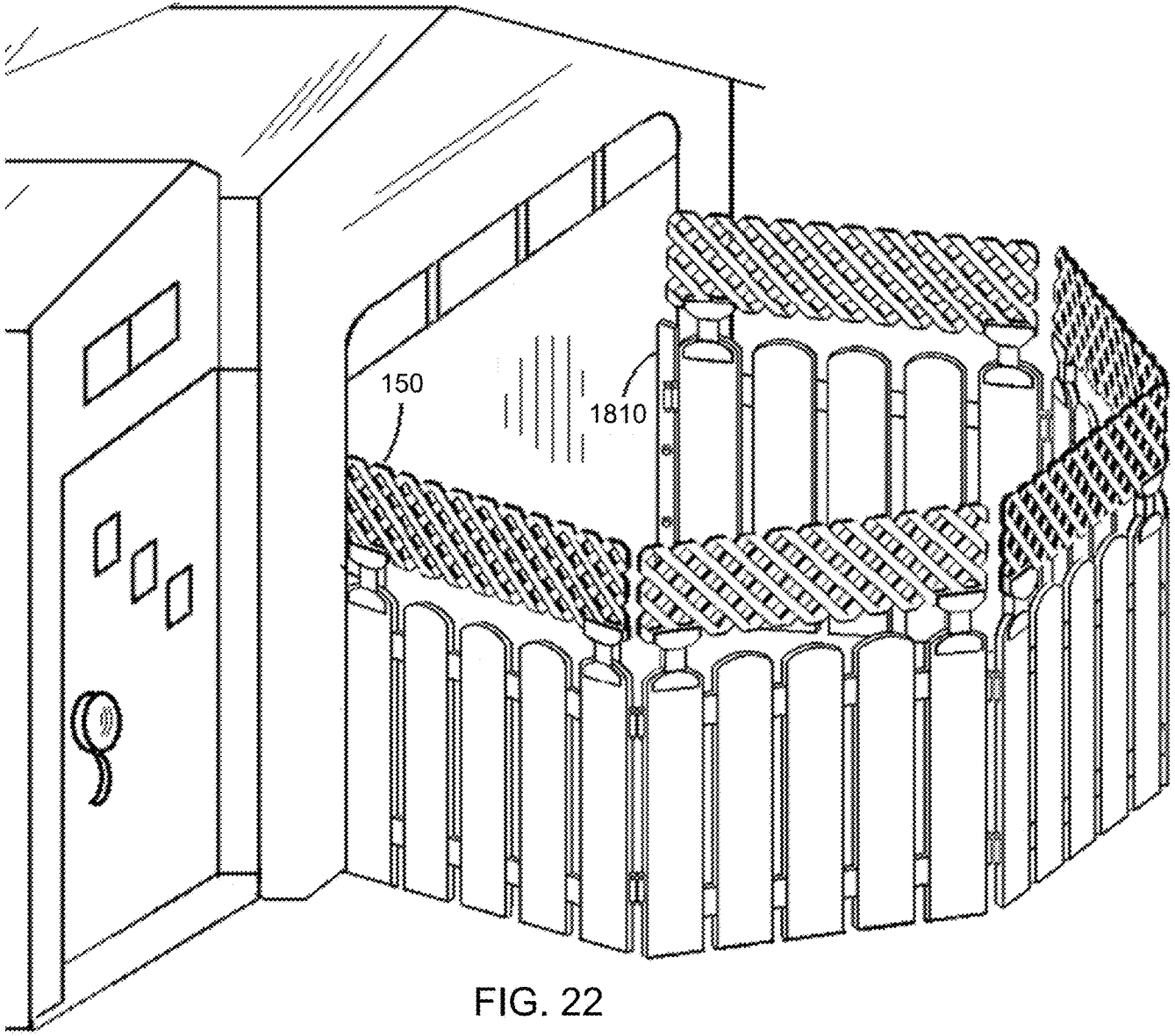
FIG. 22 depicts a perspective view of five deployed picket fence segments with privacy lattices, in accordance with some embodiments.

FIG. 22 depicts a perspective view of five deployed picket fence segments 100 with privacy lattices 150 in a fencing mode, in accordance with some embodiments. In the fencing mode, the picket fence segments 100 can extended or deployed to enclose an area to provide privacy. In some embodiments, additional picket fence segments 100 or different arrangements of picket fence segments 100 can be provided.

Figure 23:
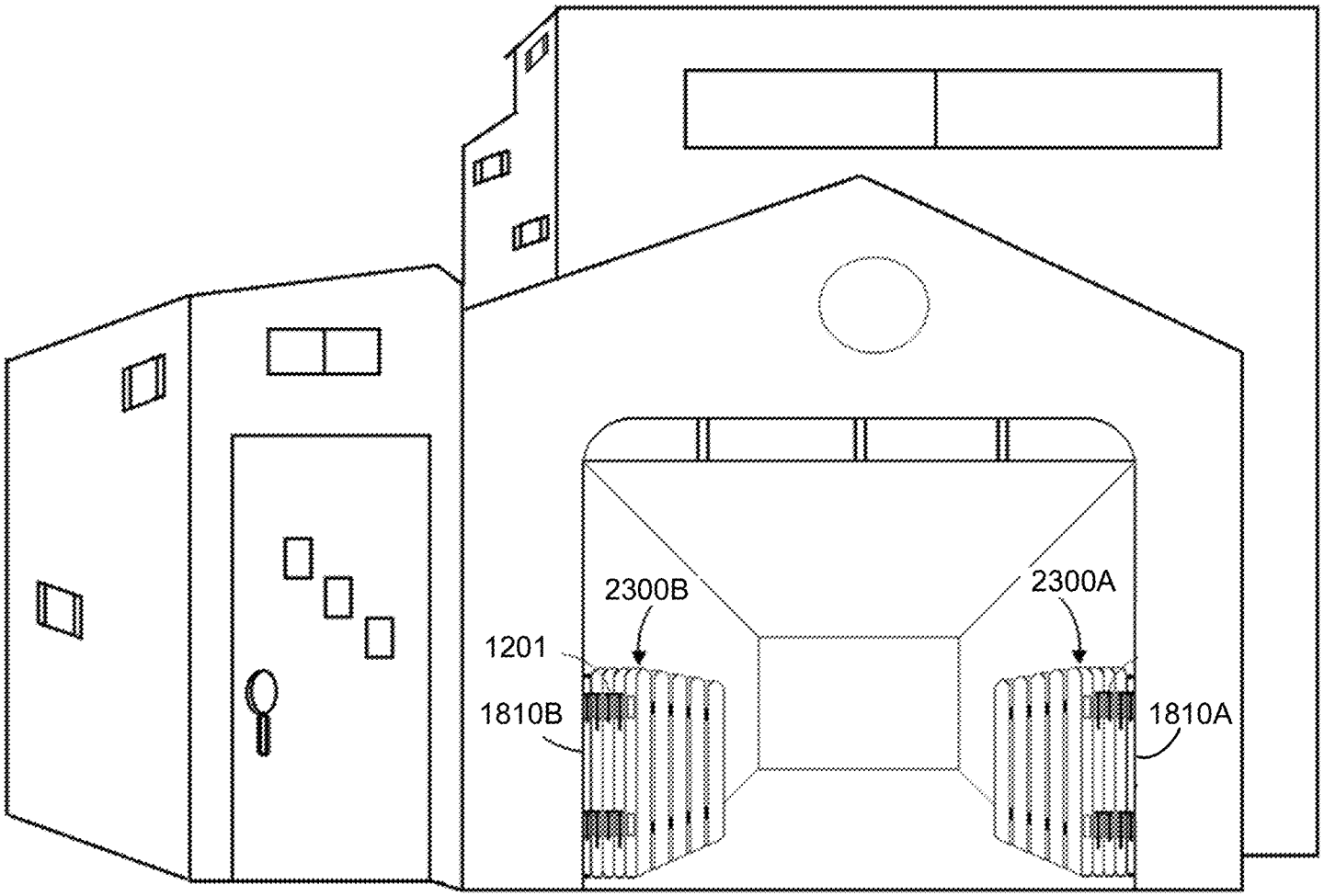
FIG. 23 depicts a front view of retracted fence segments, in accordance with some embodiments.

FIG. 23 depicts a front view of separate picket fence segments 2300A, 2300B, in accordance with some embodiments. In some embodiments, a first set of picket fence segments 2300A can be coupled to a right side of a wall or a frame of the garage, and a second set of picket fence segments 2300B can be coupled to a left side of a wall or a frame of the garage. In this embodiment, a first support structure 1810A can be mounted on the right side of the wall or the garage, and a second support structure 1810B can be mounted on the left side of the wall or the garage. Moreover, a picket fence segment of the first picket fence segments 2300A can be coupled to the first support structure 1810A through the double hinge pins 1201 and hinge knuckles 110. Similarly, a picket fence segment of the second picket fence segments 2300B can be coupled to the second support structure 1810B through the double hinge pins 1201 and hinge knuckles 110. In this configuration, the separate sets of picket fence segments 2300A, 2300B can be folded or retracted on corresponding sides in the stowage mode. In the fencing mode, the picket fence segments 2300A, 2300B can be unfolded or extended, where a last picket fence segment 100 of the picket fence segments 2300A and a last picket fence segment 100 of the picket fence segments 2300B can be coupled to each other, for example, through one or more double hinge pins 1201 to enclose an area.

Figure 24:
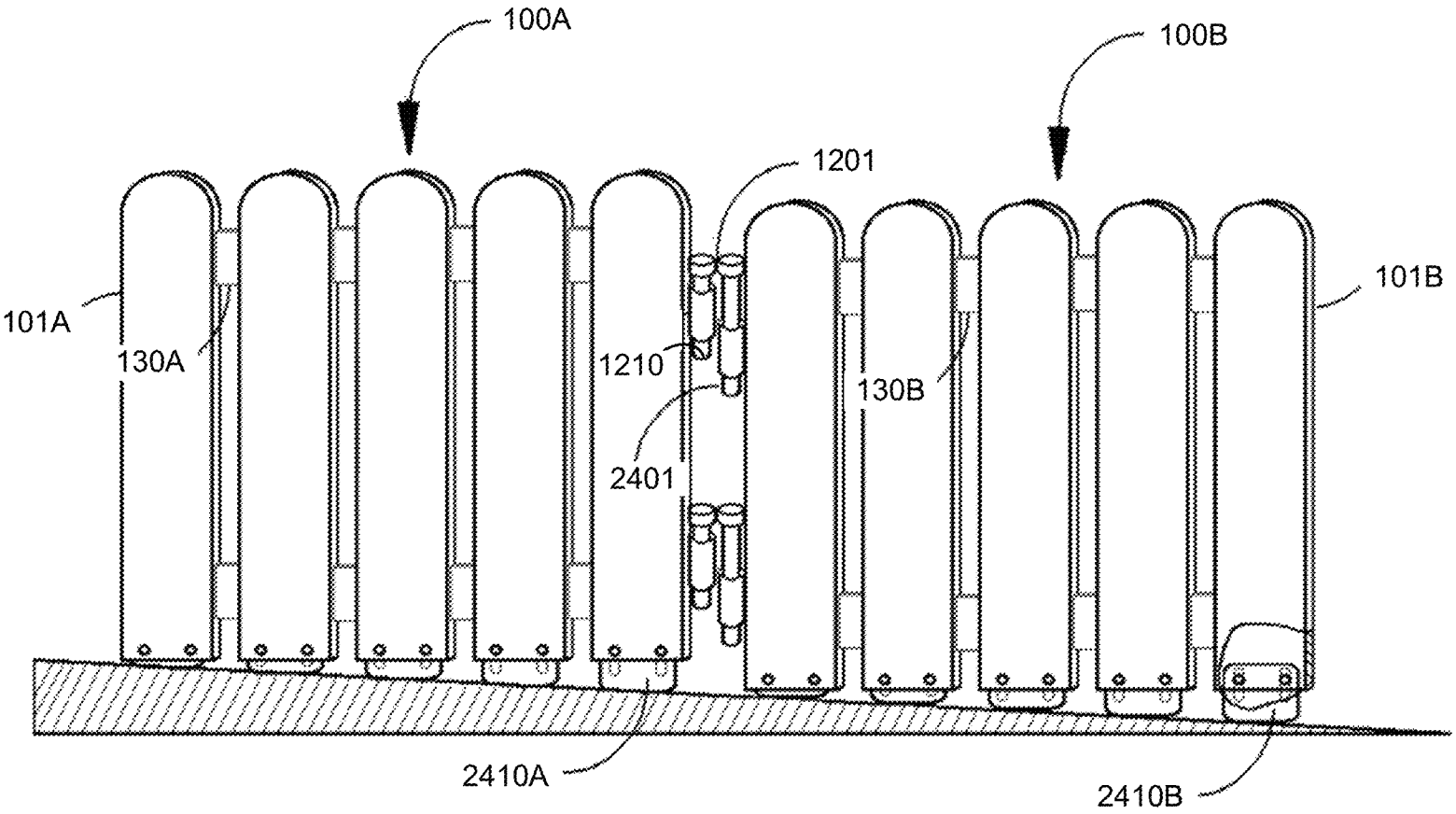
FIG. 24 depicts an open interior view of two sets of pickets on an inclined surface, in accordance with some embodiments.

FIG. 24 depicts an open interior view of two vertically offset picket fence segments 100A, 100B on an inclined surface, in accordance with some embodiments. In one aspect, levelers 2410 can be attached with fasteners across bottom ends of the pickets 101 or inserted into spaces within bottom ends of the pickets 101. When the picket fence segments 100 are unfolded on the incline surface, levelers 2410 can extend from the bottom ends of the pickets 101 by different lengths or height along a vertical direction to corresponding portions of the inclined surface, such that a set of pickets 101 in a picket fence segment 100 can be leveled. Thus, the ends of the pickets 101 in a picket fence segment 100 are extendable by different amounts. In one aspect, the double hinge pin 1201 includes two pins 1210, 2401 with different lengths. A shorter pin 1210 of the double hinge pin 1201 can be inserted into the hinge knuckle 110 coupled to a picket fence segment 100A on a higher surface, and a longer pin 2401 of the double hinge pin 1201 can be inserted into the hinge knuckle 110 coupled to picket fence segment 100B on a lower surface. Each leveler 2410 may have a weight (or a spring-loaded weight), such that when the picket fence segments 100 are unfolded, the levelers 2410 may automatically (or manually) extend from bottom ends of pickets 101 to provide structural support.

Figure 25:
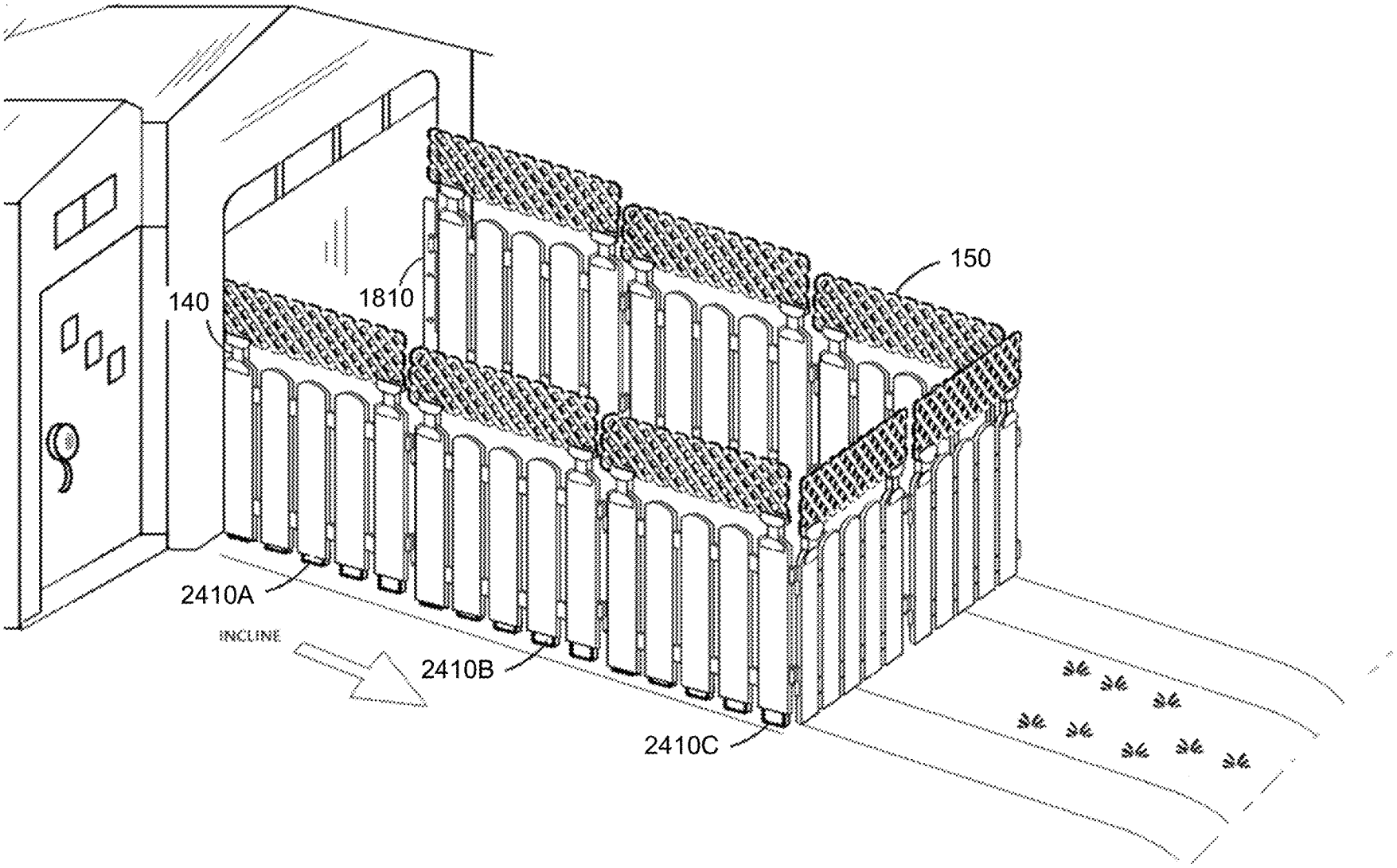
FIG. 25 depicts a perspective view eight deployed picket fence segments on an inclined surface, in accordance with some embodiments.

FIG. 25 depicts a perspective view of eight deployed picket fence segments 100 on an inclined surface, in accordance with some embodiments. In the fencing mode, the plurality of picket fence segments 100 can be extended to enclose a large area on a driveway. The picket fence segments 100 can be extended on inclined surface of the driveway, where levelers 2410 can be extended from the bottom of the pickets 101 to provide support. In the stowage mode, the plurality of picket fence segments 100 can be retracted and folded flat on one or more walls in the garage, such that the plurality of picket fence segments 100 can be stored in an area efficient manner.

The term "coupled" and variations thereof includes the joining of two members directly or indirectly to one another. The term "electrically coupled" and variations thereof includes the joining of two members directly or indirectly to one another through conductive materials (e.g., metal or cupper traces). Such joining may be stationary (e.g., permanent or fixed) or moveable (e.g., removable or releasable). Such joining may be achieved with the two members coupled directly with or to each other, with the two members coupled with each other using a separate intervening member and any additional intermediate members coupled with one another, or with the two members coupled with each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A fencing system comprising:

a first set of pickets;

a second set of pickets;

a first hinge knuckle comprising a cylindrical outer surface;

a second hinge knuckle coupled to a second side of a second picket of the second set of pickets;

a double hinge pin including a first pin and a second pin conjoined together, the first pin of the double hinge pin inserted into the first hinge knuckle, the second pin of the double hinge pin inserted into the second hinge knuckle; and an interface structure coupling the first hinge knuckle to a first flat side of a first picket of the first set of pickets, the interface structure comprising a curved surface in contact with the cylindrical outer surface of the first hinge knuckle and a flat surface in contact with the first flat side of the first picket.

2. The fencing system of claim 1, wherein the first hinge knuckle has a cylindrical internal passage with a circumference equal to or greater than a circumference of the first pin, wherein the interface structure includes a protruding structure protruding from the flat surface, the protruding structure having a shape corresponding to a portion of a shape of a hole in a picket fence wall of the first flat side of the first picket.

3. The fencing system of claim 2, wherein the interface structure includes a first locking structure extending from the flat surface, wherein a portion of the picket fence wall is positioned in a first space between the first locking structure and the flat surface of the interface structure, and wherein the protruding structure is aligned with the picket fence wall with an upper portion of the protruding structure corresponding to an upper portion of the hole in the picket fence wall.

4. The fencing system of claim 2, wherein the interface structure includes a first locking structure extending from the flat surface, wherein a portion of the picket fence wall is positioned in a first space between the first locking structure and the flat surface of the interface structure, and wherein the first locking structure includes:

a first structure coupled to the flat surface of the interface structure and a second structure coupled to the first structure, wherein the second structure is separated from the flat surface of the interface structure to define the first space, the first space having a distance greater than a thickness of the picket fence wall of the first picket.

5. The fencing system of claim 4, further comprising:

a retainer clip coupled to the second structure, the retainer clip having a perimeter larger than a circumference of the hole in the first picket.

6. The fencing system of claim 2, wherein the interface structure includes a second protruding structure protruding from the flat surface, the second protruding structure having a shape corresponding to a portion of a shape of a second hole in the picket fence wall of the first picket, the protruding structure and the second protruding structure each aligned with the picket fence wall of the first picket;

wherein the shape of the protruding structure is an upper half of a circle, and wherein the shape of the second protruding structure is a lower half of a circle.

7. The fencing system of claim 1, wherein the first set of pickets includes a third picket adjacent to the first picket, and wherein the third picket is farther away from the second picket than the first picket.

8. The fencing system of claim 1, wherein the first set of pickets is placed on a higher portion of an inclined surface of a ground than the second set of pickets, and wherein the first pin and the second pin of the double hinge pin have different lengths.

9. The fencing system of claim 8, further comprising:

a first leveler extending from an end of the first picket towards a first portion of the inclined surface; and a second leveler extending from an end of the second picket towards a second portion of the inclined surface, the first leveler extended by a larger amount than the second leveler.

10. The fencing system of claim 1, further comprising:

a first rail for coupling the first set of pickets; and a second rail for coupling the second set of pickets, wherein each picket of the first set of pickets has a first recessed outer surface, the first rail coupled to the first recessed outer surfaces of the first set of pickets, and wherein each picket of the second set of pickets has a second recessed outer surface, the second rail coupled to the second recessed outer surfaces of the second set of pickets.

11. The fencing system of claim 1, further comprising:

a first rail for coupling the first set of pickets; and a second rail for coupling the second set of pickets, wherein each picket of the first set of pickets has a first recessed inner surface, the first rail coupled to the first recessed inner surfaces of the first set of pickets, and wherein each picket of the second set of pickets has a second recessed inner surface, the second rail coupled to the second recessed inner surfaces of the second set of pickets.

12. The fencing system of claim 1, further comprising:

a third hinge knuckle coupled to a third side of a third picket of the first set of pickets; and another double hinge pin including:

a third pin inserted into the third hinge knuckle, and a fourth pin inserted into a fourth hinge knuckle coupled to a wall adjacent to a door or a frame of the door, wherein each pin of each double hinge pin includes a head, each head wider than a diameter of the respective pin, wherein the heads of the pins of each double hinge pin are conjoined to form the respective double hinge pin.

13. The fencing system of claim 1, further comprising:

a stake extending from an end of the first picket towards a surface of a ground.

14. The fencing system of claim 1, further comprising:

a lattice; and a lattice holder including:

a picket end including two first arms that are spaced by a first thickness of the first picket, the first picket to slide into the two first arms of the picket end, and a lattice end including two second arms spaced by a second thickness of the lattice, the lattice to slide into the two second arms of the lattice end.

15. A fencing system, comprising:

a first set of pickets;

a second set of pickets;

a first hinge knuckle coupled to a first side of a first picket of the first set of pickets by an interface structure in contact with the first side of the first picket, the interface structure comprising a curved surface in contact with a cylindrical outer surface of the first hinge knuckle, the first hinge knuckle comprising a single vertical opening;

a second hinge knuckle coupled to a second side of a second picket of the second set of pickets, the second hinge knuckle comprising a single vertical opening; and a double hinge pin including a first pin and a second pin conjoined together, the first pin of the double hinge pin inserted into the vertical opening of the first hinge knuckle, the second pin of the double hinge pin inserted into the vertical opening of the second hinge knuckle, wherein a thickness of the first set of pickets, a thickness of the second set of pickets, and a distance between first pin and the second pin enable the first set of pickets to be folded flat against the second set of pickets in a first configuration.

16. The fencing system of claim 15, wherein the first set of pickets and the second set of pickets are configured to be unfolded into a second configuration.

17. A fencing system, comprising:

a plurality of picket fence segments;

a plurality of hinge knuckles, each of the plurality of hinge knuckles comprising a cylindrical outer surface;

a plurality of interface structures, each interface structure of the plurality of interface structures coupling a respective hinge knuckle of the plurality of hinge knuckles to a flat side of a respective picket of a respective picket fence segment of the plurality of picket fence segments, each interface structure comprising a curved surface in contact with the cylindrical outer surface of the respective hinge knuckle and a flat surface in contact with the flat side of the respective picket; and a plurality of double hinge pins, each double hinge pin including a first pin and a second pin coupled to the first pin, wherein the first pin of a first double hinge pin of the plurality of double hinge pins is inserted into a first hinge knuckle of the plurality of hinge knuckles coupled to a first picket of a first picket fence segment of the plurality of picket fence segments, and the second pin of the first double hinge pin of the plurality of double hinge pins is inserted into a second hinge knuckle of the plurality of hinge knuckles coupled to a second picket of a second picket fence segment of the plurality of picket fence segments adjacent to the first picket fence segment.

18. The fencing system of claim 17, wherein the first picket fence segment of the plurality of picket fence segments is vertically offset with respect to the second picket fence segment of the plurality of picket fence segments, and wherein the first pin and the second pin of each double hinge pin have different lengths.

19. The fencing system of claim 17, wherein ends of pickets of each of the plurality of picket fence segments are extendable by different amounts.

20. The fencing system of claim 17, wherein a third hinge knuckle of the plurality of hinge knuckles is coupled to a second picket of the first picket fence segment, and wherein the first pin of a second double hinge pin of the plurality of double hinge pins is inserted into the third hinge knuckle of the plurality of hinge knuckles, and the second pin of the second double hinge pin of the plurality of double hinge pins is inserted into a fourth hinge knuckle coupled to a wall adjacent to a door or a frame of the door.

* * * * *